US010976017B2

(12) United States Patent
Chang et al.

(10) Patent No.: US 10,976,017 B2
(45) Date of Patent: Apr. 13, 2021

(54) DECORATIVE LIGHTS AND RELATED METHODS

(71) Applicant: Gemmy Industries Corp., Coppell, TX (US)

(72) Inventors: Lio Yenwei Chang, Lewisville, TX (US); Cheng-Chun Zhang, Shenzhen (CN)

(73) Assignee: GEMMY INDUSTRIES CORP., Coppell, TX (US)

( * ) Notice: Subject to any disclaimer, the term of this patent is extended or adjusted under 35 U.S.C. 154(b) by 0 days.

(21) Appl. No.: 16/520,805

(22) Filed: Jul. 24, 2019

(65) Prior Publication Data

US 2019/0346101 A1 Nov. 14, 2019

Related U.S. Application Data

(60) Division of application No. 15/492,735, filed on Apr. 20, 2017, now Pat. No. 10,400,966, which is a (Continued)

(51) Int. Cl.
*F21S 10/00* (2006.01)
*F21V 15/01* (2006.01)
(Continued)

(52) U.S. Cl.
CPC ..... *F21S 10/007* (2013.01); *A63G 31/12* (2013.01); *A63H 3/006* (2013.01); *A63H 3/06* (2013.01);
(Continued)

(58) Field of Classification Search
CPC . A63J 5/025; A63J 5/028; F21V 13/02; F21V 3/026; F21V 5/004; F21V 5/008;
(Continued)

(56) References Cited

U.S. PATENT DOCUMENTS 2,726,571 A 12/1955 Chang
2,959,094 A 11/1960 Kosma
(Continued)

FOREIGN PATENT DOCUMENTS

CN 202675014 U 1/2013
CN 203052473 U 7/2013
(Continued)

OTHER PUBLICATIONS

Notice of Allowance dated Feb. 27, 2015 in U.S. Appl. No. 14/079,628. [Cited in Parent].
(Continued)

*Primary Examiner* — Matthew J. Peerce
*Assistant Examiner* — Steven Y Horikoshi
(74) *Attorney, Agent, or Firm* — Venable LLP; Michele V. Frank

(57) ABSTRACT

A decorative light can include: a housing defining an interior space and having an open front; a cover mounted to the open front of the housing, the cover including a beam-splitter light lens shade and a substantially planar lens portion disposed around the beam-splitter light lens shade; a motor located in the interior space of the housing, the motor including an output shaft; a first light module located in the interior space and including first light units disposed about the output shaft of the motor, where the output shaft is rotatable with respect to the first light units; a second light module located in the interior space and including second light units disposed about the output shaft of the motor, wherein the output shaft is rotatable with respect to the second light units; and a rotating lens module connected to the output shaft of the motor for rotation.

14 Claims, 13 Drawing Sheets

Related U.S. Application Data continuation-in-part of application No. 15/341,730, filed on Nov. 2, 2016, now abandoned, which is a continuation-in-part of application No. 15/200,291, filed on Jul. 1, 2016, now Pat. No. 9,696,025, which is a continuation of application No. 14/145,512, filed on Dec. 31, 2013, now Pat. No. 9,664,373, said application No. 15/492,735 is a continuation-in-part of application No. 15/018,458, filed on Feb. 8, 2016, now Pat. No. 9,890,938.

(51) Int. Cl.

| | |
|---|---|
| ***F21V 23/02*** | (2006.01) |
| ***F21V 21/08*** | (2006.01) |
| ***A63H 27/10*** | (2006.01) |
| ***A63G 31/12*** | (2006.01) |
| ***F21V 29/73*** | (2015.01) |
| ***F21V 5/00*** | (2018.01) |
| ***F21V 14/06*** | (2006.01) |
| ***A63H 3/00*** | (2006.01) |
| ***F21V 5/04*** | (2006.01) |
| ***F21V 3/02*** | (2006.01) |
| ***A63H 3/06*** | (2006.01) |
| ***F21V 13/02*** | (2006.01) |
| *F21W 131/10* | (2006.01) |
| *F21Y 115/10* | (2016.01) |
| *F21Y 113/13* | (2016.01) |
| *F21Y 115/30* | (2016.01) |
| *F21W 121/00* | (2006.01) |
| *F21V 27/02* | (2006.01) |
| *F21V 17/02* | (2006.01) |
| *F21V 21/06* | (2006.01) |
| *F21S 10/02* | (2006.01) |

(52) U.S. Cl.

CPC ..... *A63H 27/10* (2013.01); *F21V 3/026* (2013.01); *F21V 5/008* (2013.01); *F21V 5/04* (2013.01); *F21V 13/02* (2013.01); *F21V 14/06* (2013.01); *F21V 15/01* (2013.01); *F21V 21/0824* (2013.01); *F21V 23/02* (2013.01); *F21V 29/73* (2015.01); *A63H 2027/1033* (2013.01); *A63H 2027/1058* (2013.01); *F21S 10/02* (2013.01); *F21V 17/02* (2013.01); *F21V 21/06* (2013.01); *F21V 27/02* (2013.01); *F21W 2121/00* (2013.01); *F21W 2121/006* (2013.01); *F21W 2131/10* (2013.01); *F21Y 2113/13* (2016.08); *F21Y 2115/10* (2016.08); *F21Y 2115/30* (2016.08)

(58) Field of Classification Search

CPC ..... F21V 5/04; F21V 14/06; F21V 14/065; F21V 21/0824; A63G 31/12; A63H 3/006; A63H 3/06; A63H 27/10; F21W 2121/008; F21S 10/007; F21S 10/06; F21S 10/063; F21S 8/032

See application file for complete search history.

(56) References Cited

U.S. PATENT DOCUMENTS

| | | | |
|---|---|---|---|
| 3,263,069 | A | 7/1966 | Krucki et al. |
| 3,767,299 | A | 10/1973 | Fisher |
| 3,861,632 | A | 1/1975 | Siilats |
| 3,949,350 | A | 4/1976 | Smith |
| 4,107,764 | A | 8/1978 | Riley |
| 4,249,331 | A | 2/1981 | Vernon |
| 4,307,528 | A | 12/1981 | Dewees et al. |
| 4,779,176 | A | 10/1988 | Bornhorst |
| 4,858,079 | A | 8/1989 | Ohashi |
| 4,870,548 | A | 9/1989 | Beachy et al. |
| 5,041,947 | A | 8/1991 | Yuen et al. |
| 5,084,803 | A | 1/1992 | Lan |
| 5,178,454 | A | 1/1993 | Lai |
| 5,247,492 | A | 9/1993 | Pan |
| 5,324,224 | A | 6/1994 | Anderson et al. |
| D365,169 | S | 12/1995 | Fillipp |
| 5,517,264 | A | 5/1996 | Sutton |
| 5,531,411 | A | 7/1996 | Adams |
| 5,555,658 | A | 9/1996 | Yu |
| D377,844 | S | 2/1997 | Gary et al. |
| 5,688,042 | A | 11/1997 | Madadi et al. |
| 5,772,166 | A | 6/1998 | Adams |
| 5,816,687 | A | 10/1998 | Tapp |
| 5,893,633 | A | 4/1999 | Uchio et al. |
| D414,579 | S | 9/1999 | Denison et al. |
| 6,011,650 | A | 1/2000 | Parker et al. |
| 6,050,697 | A | 4/2000 | Bennington |
| 6,056,422 | A | 5/2000 | Huang |
| 6,109,765 | A | 8/2000 | Blanton |
| D450,339 | S | 11/2001 | Eason |
| 6,361,192 | B1 | 3/2002 | Fussell et al. |
| 6,424,096 | B1 | 7/2002 | Lowe et al. |
| 6,431,719 | B1 | 8/2002 | Lau et al. |
| 6,467,929 | B2 | 10/2002 | Lee |
| 6,474,837 | B1 | 11/2002 | Belliveau |
| 6,478,453 | B2 | 11/2002 | Lammers et al. |
| 6,558,022 | B2 | 5/2003 | Kawahara |
| 6,584,713 | B2 | 7/2003 | Huang |
| D495,444 | S | 8/2004 | Lam |
| 6,786,793 | B1 | 9/2004 | Wang |
| 6,787,999 | B2 | 9/2004 | Stimac et al. |
| 7,033,037 | B2 | 4/2006 | Chen |
| 7,056,006 | B2 | 6/2006 | Smith |
| 7,063,553 | B1 | 6/2006 | Mullen |
| 7,182,472 | B2 | 2/2007 | Vitantonio et al. |
| D542,959 | S | 5/2007 | Yao |
| D546,489 | S | 7/2007 | Yuen |
| 7,244,044 | B2 | 7/2007 | Liao |
| 7,296,909 | B2 | 11/2007 | Van Deursen et al. |
| D559,091 | S | 1/2008 | Skorka |
| 7,320,533 | B1 | 1/2008 | Beadle |
| 7,329,035 | B2 | 2/2008 | Feliciano |
| D574,532 | S | 8/2008 | Lee et al. |
| 7,416,308 | B2 | 8/2008 | Hermanson et al. |
| 7,458,698 | B2 | 12/2008 | Heathcock et al. |
| 7,473,002 | B1 | 1/2009 | Chen |
| 7,478,912 | B2 | 1/2009 | Black, Jr. |
| RE41,050 | E | 12/2009 | Panasewicz et al. |
| 7,717,570 | B2 | 5/2010 | Black, Jr. |
| 7,780,317 | B2 | 8/2010 | Schroll et al. |
| 7,784,961 | B1 | 8/2010 | Rawlings |
| D623,786 | S | 9/2010 | Wessel |
| D625,871 | S | 10/2010 | Huang |
| 7,832,917 | B2 | 11/2010 | Chien |
| 7,871,192 | B2 | 1/2011 | Chien |
| 7,883,261 | B2 | 2/2011 | Yu |
| 7,887,194 | B2 | 2/2011 | Ohira |
| 7,896,520 | B1 | 3/2011 | Norling et al. |
| 8,002,456 | B2 | 8/2011 | Chien |
| 8,007,129 | B2 | 8/2011 | Yang |
| 8,057,045 | B2 | 11/2011 | Johnson |
| 8,128,274 | B2 | 3/2012 | Chien |
| D659,871 | S | 5/2012 | Lee et al. |
| 8,231,260 | B2 | 7/2012 | Chien |
| 8,262,252 | B2 | 9/2012 | Bergman et al. |
| 8,303,150 | B2 | 11/2012 | Chien |
| 8,408,736 | B2 | 4/2013 | Chien |
| 8,449,145 | B1 | 5/2013 | Berry et al. |
| 8,511,877 | B2 | 8/2013 | Chien |
| 8,641,230 | B1 | 2/2014 | Jiang |
| 8,668,349 | B2 | 3/2014 | Richardson |
| 8,714,799 | B2 | 5/2014 | Chien |
| 8,721,160 | B2 | 5/2014 | Chien |
| 8,764,253 | B2 | 7/2014 | Ko et al. |
| 8,884,501 | B2 | 11/2014 | Cho et al. |
| 9,097,909 | B2 | 8/2015 | Halushka |
| 9,157,589 | B2 | 10/2015 | Chien |

(56) References Cited

U.S. PATENT DOCUMENTS

| | | | |
|---|---|---|---|
| D743,603 | S | 11/2015 | Inskeep |
| 9,230,519 | B1 | 1/2016 | Beller |
| 9,395,608 | B2 | 7/2016 | Zhang |
| D770,657 | S | 11/2016 | Fang |
| D773,707 | S | 12/2016 | Lentine |
| 9,719,654 | B2 | 8/2017 | Chien |
| D798,484 | S | 9/2017 | Lentine |
| 9,909,739 | B2 | 3/2018 | Chien |
| 10,047,922 | B2 | 8/2018 | Chien |
| 2002/0048169 | A1 | 4/2002 | Dowling et al. |
| 2002/0105808 | A1 | 8/2002 | Ting Yup |
| 2003/0231497 | A1 | 12/2003 | Sakata et al. |
| 2004/0037079 | A1 | 2/2004 | Luk |
| 2004/0119951 | A1 | 6/2004 | Vitantonio et al. |
| 2004/0156117 | A1 | 8/2004 | Takaura et al. |
| 2005/0195598 | A1 | 9/2005 | Dancs et al. |
| 2005/0243560 | A1 | 11/2005 | Chen |
| 2006/0044532 | A1 | 3/2006 | Black |
| 2006/0067071 | A1 | 3/2006 | Quittner |
| 2006/0120089 | A1 | 6/2006 | Liberatore |
| 2006/0176703 | A1 | 8/2006 | Cayton et al. |
| 2006/0277823 | A1 | 12/2006 | Barnett et al. |
| 2007/0008730 | A1 | 1/2007 | Hsieh |
| 2007/0019441 | A1 | 1/2007 | Moreland |
| 2007/0097681 | A1 | 5/2007 | Chich et al. |
| 2007/0127273 | A1 | 6/2007 | Tsai |
| 2007/0279920 | A1 | 12/2007 | Lin |
| 2008/0165527 | A1 | 7/2008 | Vanderschuit |
| 2008/0239716 | A1 | 10/2008 | Lin |
| 2008/0304289 | A1 | 12/2008 | Chien |
| 2009/0027876 | A1 | 1/2009 | Yu |
| 2009/0027900 | A1 | 1/2009 | Janos et al. |
| 2009/0122548 | A1 | 5/2009 | Dalsgaard |
| 2009/0185377 | A1 | 7/2009 | Johnson |
| 2009/0268466 | A1 | 10/2009 | Allegri |
| 2010/0091491 | A1 | 4/2010 | Jiang et al. |
| 2010/0118554 | A1 | 5/2010 | Kraus, Jr. et al. |
| 2010/0214783 | A1 | 8/2010 | Liu |
| 2010/0271815 | A1 | 10/2010 | Gomez |
| 2011/0051097 | A1 | 3/2011 | Lin |
| 2011/0116051 | A1 | 5/2011 | Young et al. |
| 2011/0194292 | A1 | 8/2011 | Tsai |
| 2011/0222274 | A1 | 9/2011 | Ko et al. |
| 2011/0280015 | A1 | 11/2011 | Li et al. |
| 2011/0286200 | A1 | 11/2011 | Iimura et al. |
| 2012/0147608 | A1 | 6/2012 | Kawagoe et al. |
| 2012/0147609 | A1 | 6/2012 | Black et al. |
| 2012/0182743 | A1 | 7/2012 | Chou |
| 2012/0218464 | A1 | 8/2012 | Ben-Moshe et al. |
| 2012/0257418 | A1 | 10/2012 | Fields et al. |
| 2012/0300429 | A1 | 11/2012 | Jin |
| 2013/0027940 | A1 | 1/2013 | Zhang |
| 2013/0094193 | A1 | 4/2013 | Baxter et al. |
| 2013/0135866 | A1 | 5/2013 | Souvay et al. |
| 2013/0148366 | A1 | 6/2013 | Adams, IV et al. |
| 2013/0242560 | A1 | 9/2013 | Hsu |
| 2014/0001507 | A1 | 1/2014 | Steppel et al. |
| 2014/0056011 | A1 | 2/2014 | Clement et al. |
| 2014/0085869 | A1 | 3/2014 | Quittner |
| 2014/0301071 | A1* | 10/2014 | Jorgensen ..... F21V 21/30 362/231 |
| 2015/0036354 | A1 | 2/2015 | Adams et al. |
| 2015/0070936 | A1 | 3/2015 | Chien |
| 2015/0131288 | A1 | 5/2015 | Zhang |
| 2015/0159844 | A1 | 6/2015 | Flaherty et al. |
| 2015/0211708 | A1* | 7/2015 | Stavely ..... F21V 14/06 348/164 |
| 2016/0047516 | A1 | 2/2016 | Taylor |
| 2016/0215961 | A1 | 7/2016 | Kjeldsen et al. |
| 2017/0237841 | A1 | 8/2017 | Duffy et al. |

FOREIGN PATENT DOCUMENTS

| | | |
|---|---|---|
| CN | 203070724 U | 7/2013 |
| CN | 103292217 A | 9/2013 |
| DK | PA 2013 00566 | 9/2014 |
| DK | PA 2013 70677 | 9/2014 |
| DK | PA 2013 70679 | 9/2014 |
| EP | 2146139 A1 | 1/2010 |
| EP | 1428415 B1 | 7/2012 |
| WO | 03/026358 A1 | 3/2003 |

OTHER PUBLICATIONS

Office Action dated Feb. 26, 2015 in U.S. Appl. No. 14/145,512. [Cited in Parent].

Office Action dated Apr. 9, 2015 in U.S. Appl. No. 14/098,594. [Cited in Parent].

Office Action dated Nov. 13, 2015 in U.S. Appl. No. 14/145,512. [Cited in Parent].

Office Action dated Sep. 23, 2016 in U.S. Appl. No. 15/200,291. [Cited in Parent].

Office Action dated Mar. 9, 2017 in U.S. Appl. No. 15/341,730. [Cited in Parent].

Notice of Allowance dated Mar. 29, 2017 in Design U.S. Appl. No. 29/554,097. [Cited in Parent].

Office Action dated Nov. 29, 2017 in U.S. Appl. No. 15/341,730. [Cited in Parent].

"TSSS LED RGB Crystal Light Rotating Rainbow Color Effect Stage Disco DJ Wedding Family Birthday Children celebration Event Home Party Lighting Effect," Amazon.com, Retrieved from the Internet on Dec. 19, 2017, 8 pages, URL: http://www.amazon.come/gp/product/B00B1YOENI/ref=oh_aui_detailpage_o00_s00?ie=UTF8&psc=1 [Cited in Parent].

Notice of Allowance dated Dec. 11, 2017 in U.S. Appl. No. 29/607,096. [Cited in Parent].

Notice of Allowance dated Feb. 8, 2018 in U.S. Appl. No. 15/860,125. [Available in IFW].

Office Action dated Mar. 15, 2018 in U.S. Appl. No. 15/599,165. [Cited in Parent].

Office Action dated Mar. 16, 2018 in U.S. Appl. No. 15/589,507. [Cited in Parent].

Notice of Allowance dated Oct. 18, 2017 in U.S. Appl. No. 15/018,458. [Cited in Parent].

Notice of Allowance dated Nov. 7, 2018 in U.S. Appl. No. 16/000,514. [Available in IFW].

Notice of Allowance dated Apr. 25, 2019 in U.S. Appl. No. 15/492,735. [Available in IFW].

* cited by examiner

DECORATIVE LIGHTS AND RELATED METHODS

CROSS-REFERENCE TO RELATED APPLICATIONS

This application is a divisional of U.S. application Ser. No. 15/492,735, filed in Apr. 20, 2017, which is a continuation-in-part of U.S. application Ser. No. 15/341,730, filed on Nov. 2, 2016, which in turn is a continuation-in-part of U.S. application Ser. No. 15/200,291, filed on Jul. 1, 2016, now issued as U.S. Pat. No. 9,696,025, which in turn is a continuation of U.S. application Ser. No. 14/145,512, filed on Dec. 31, 2013, now issued as U.S. Pat. No. 9,664,373. U.S. application Ser. No. 15/492,735 is further a continuation-in-part of U.S. application Ser. No. 15/018,458, filed on Feb. 8, 2016, now issued as U.S. Pat. No. 9,890,938. The entire contents of each of the foregoing applications is expressly incorporated herein by reference.

TECHNICAL FIELD

The present application relates generally to decorative lights, such as decorative outdoor spotlights, and related methods. More specifically, the present application relates to decorative outdoor lights that have various combinations of static and/or dynamic lighting effects, and related methods.

BACKGROUND

Lighting is often used during the holidays, such as Christmas or Halloween, to decorate a person's house or yard. For example, a person may install one or more decorative outdoor spotlights on their yard to project decorative patterns onto their house, trees, or other backdrop. Examples of decorative outdoor spotlights are described in Applicant's co-owned U.S. Pat. Nos. 9,068,726 and 9,310,059, the entire contents of which are incorporated herein by reference.

SUMMARY

According to an embodiment, a decorative light can include: a housing defining an interior space and having an open front; a cover mounted to the open front of the housing, the cover including a beam-splitter light lens shade and a substantially planar lens portion disposed around the beam-splitter light lens shade; a motor located in the interior space of the housing, the motor including an output shaft; a first light module located in the interior space and including a plurality of first light units disposed about the output shaft of the motor, wherein the output shaft is rotatable with respect to the first light units; a second light module located in the interior space and including a plurality of second light units disposed about the output shaft of the motor, wherein the output shaft is rotatable with respect to the second light units; and a rotating lens module connected to the output shaft of the motor for rotation therewith, the rotating lens module comprising: a centrally located refractive lens, wherein the plurality of second light units are adapted to project light through the centrally located refractive lens and the beam-splitter lens light shade, and a plurality of rotating lenses distributed about the refractive lens, wherein the plurality of first light units are adapted to project light through the rotating lenses and the substantially planar lens portion of the cover.

According to an embodiment, a decorative light can include: a housing defining an interior space and having an open front; a cover mounted to the open front of the housing, the cover being substantially transparent or translucent; a motor located in the interior space of the housing, the motor including an output shaft; and a light module located in the interior space, the light module including: a plurality of light units directed toward the cover, and a plurality of film slides each containing a negative image, wherein the plurality of film slides are located in registry the light units. The decorative light can further include: a rotating lens module located between the light module and the cover, the rotating lens module including a plurality of rotating lenses; and a stationary lens module located between the light module and the cover, the stationary lens module including one or more stationary lenses. The motor can drive the rotating lens module to rotate the plurality of rotating lenses about the one or more stationary lenses.

According to an embodiment, a decorative light can include: a housing defining an interior space and having first and second front openings; a cover mounted over the first opening, the cover including a beam-splitter light lens shade; a lens mounted over the second opening; a motor located in the interior space of the housing, the motor including an output shaft; a first light module located in the interior space and including a plurality of first light units disposed about the output shaft of the motor, wherein the output shaft is rotatable with respect to the first light units; a refractive lens attached to an end of the output shaft for rotation therewith, the refractive lens including a plurality of multi-angle refractive lens bodies, wherein the first light units are adapted to emit light through the refractive lens and the cover; a second light module located in the interior space and including a second light unit; a film slide containing a negative image; and a large aperture lens, wherein the second light unit is adapted to emit light through the film slide, the large aperture lens, and the focus lens.

Additional features, advantages, and embodiments of the invention are set forth or apparent from consideration of the following detailed description, drawings and claims. Moreover, it is to be understood that both the foregoing summary of the invention and the following detailed description are examples only, and are intended to provide further explanation without limiting the scope of the invention as claimed.

BRIEF DESCRIPTION OF THE DRAWINGS

The foregoing and other features and advantages of the invention will be apparent from the following, more particular description, as illustrated in the accompanying drawings wherein like reference numbers generally indicate identical, functionally similar, and/or structurally similar elements.

DETAILED DESCRIPTION

Embodiments of the invention are discussed in detail below. In describing embodiments, specific terminology is employed for the sake of clarity. However, the invention is not intended to be limited to the specific terminology so selected. While specific embodiments are discussed, it should be understood that this is done for illustration purposes only. A person skilled in the relevant art will recognize that other components and configurations can be used without departing from the spirit and scope of the invention.

The present application relates to decorative lights or spotlights, which may be referred to interchangeably herein, and without limitation. Embodiments of the decorative lights according to the present invention may be used to project decorative images onto a structure, such as a house, tree, or other backdrop. As discussed herein, embodiments can project images that include various combinations of static and/or moving images.

First Embodiment

Figure 1:
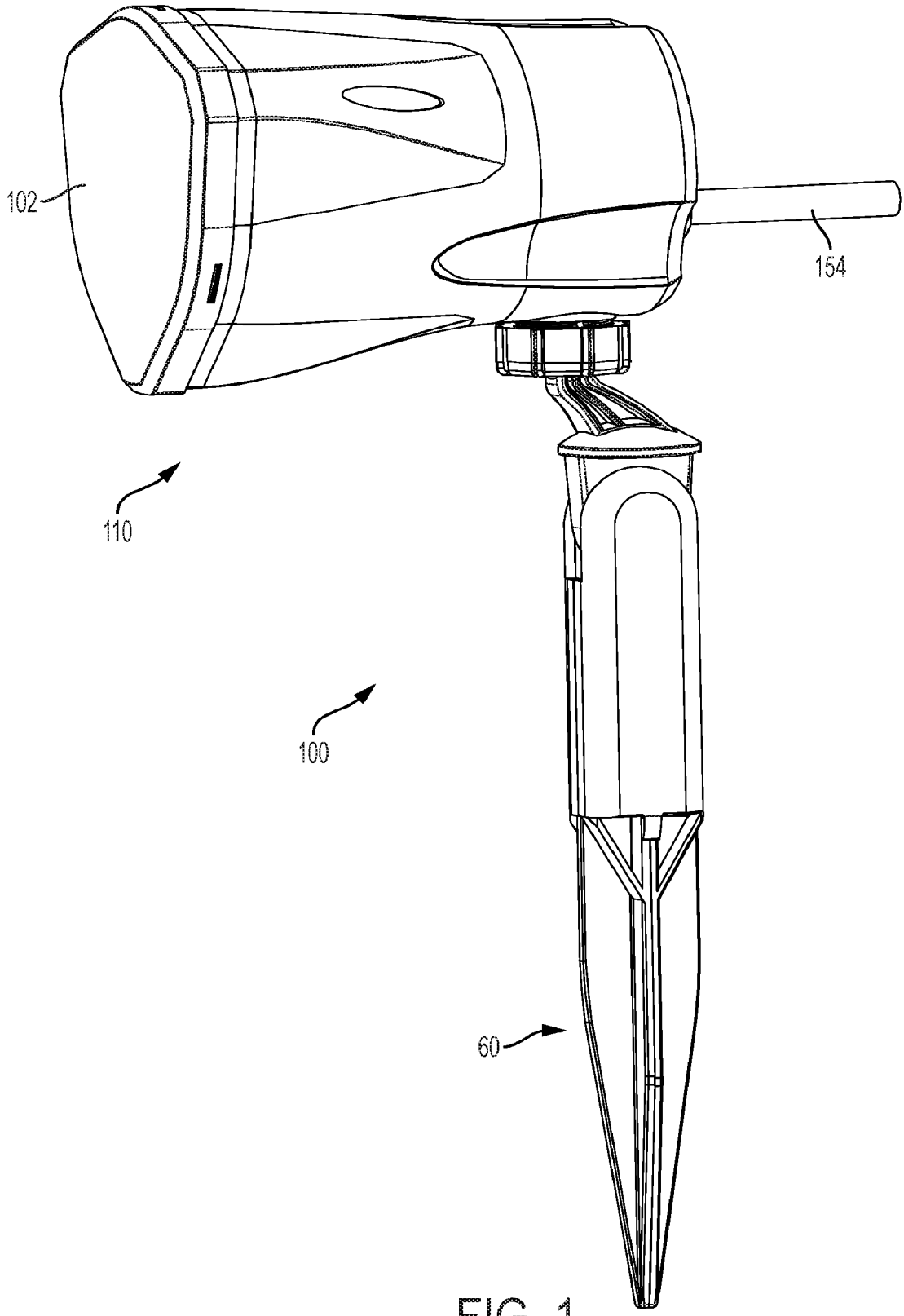
FIG. 1 is a front-side perspective view of an embodiment of a decorative light.
Figure 2:
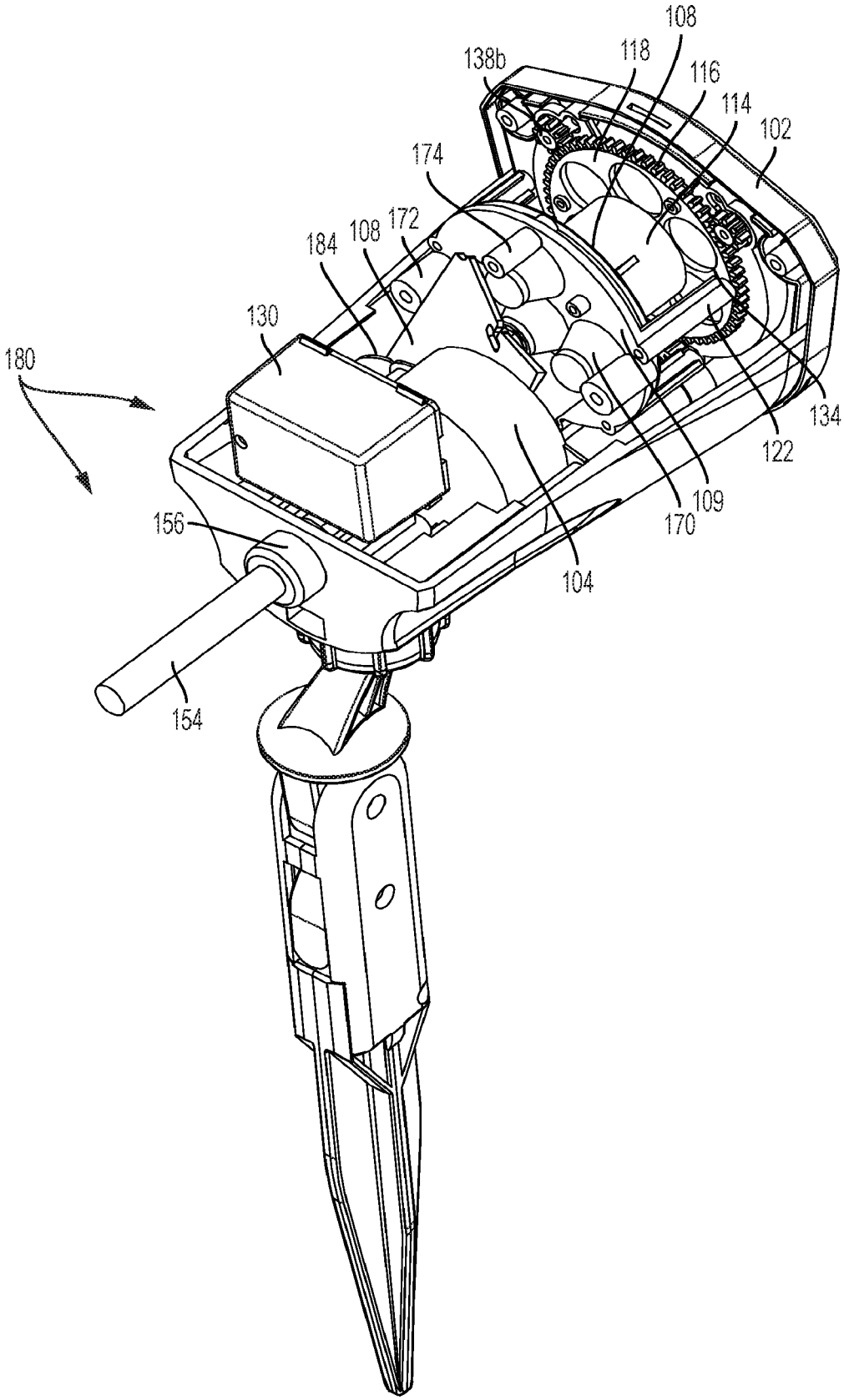
FIG. 2 is a rear-side perspective view of the decorative light of FIG. 1, shown with portions removed.
Figure 3:
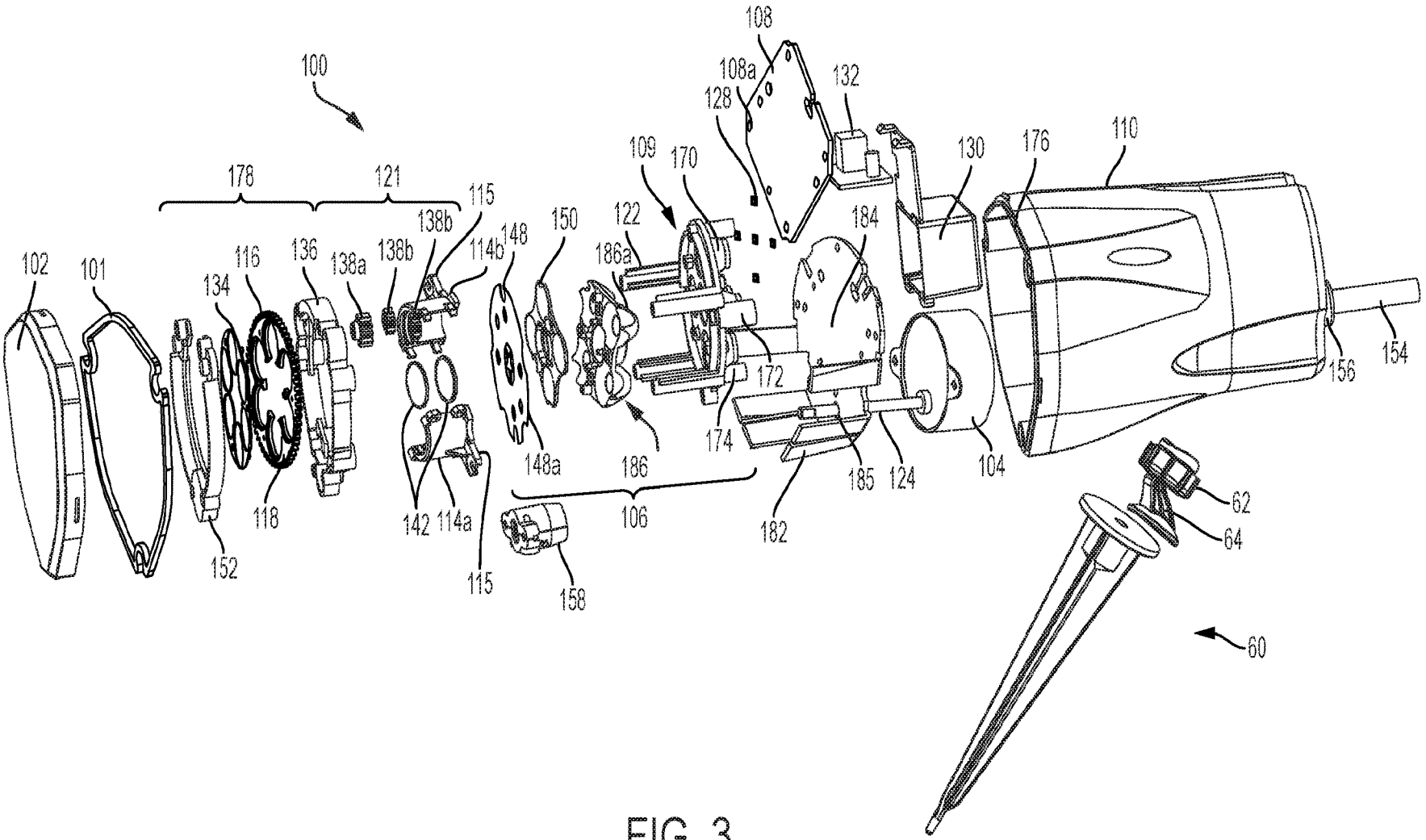
FIG. 3 is an exploded view of the decorative light of FIG. 1.

With reference to FIGS. 1-3, an embodiment of a decorative light 100 is shown. The decorative light 100 can include a housing 110. The housing 110 can be formed partially or entirely of plastic, metal, or other suitably rigid material. The housing 110 can define an open interior space and can have an open front 176 (see FIG. 3). The housing 110 can include a cover 102 mounted to the open front 176 to enclose the interior space, for example, using screws, adhesives, snap connectors, or other fasteners. The housing 110 and its cover 102 can enclose the interior space in a weatherproof fashion. For example, according to embodiments, a sealing ring or gasket 101 (see FIG. 3) can provide a weatherproof seal at the interface of the housing 110 and cover 102, such that the housing 110 is weatherproof. Accordingly, embodiments of the decorative light can be used in an outdoor environment. The cover 102 can be substantially transparent or translucent. FIG. 1 also depicts a power cable 154 that can be used to supply electrical power (e.g., from an 110V AC power outlet) to the electrical components of the decorative light 100. Thus, the power cable 154 can be an AC power cord. The decorative light 100 can be plugged into an AC power outlet directly, supplying electrical power to the built-in motor 104 and/or DC power converter.

Referring to FIGS. 2 and 3, the decorative light 100 can include the motor 104 located in the inner space of the housing 110. The motor 104 can be electrically connected with a power supply 180 (e.g. via wires or other conductors), such that the power supply 180 provides electric power, e.g., in the form of DC power, to the motor 104, as well as other components of the light 100. According to embodiments, the motor 104 can comprise a DC electric motor having an output shaft 124 (see FIG. 3) extending through the interior space of the housing 110 toward the cover 102.

Referring to FIG. 3, a light module 106 can be mounted in the interior space of the housing 110, for example, in a stationary manner. The light module 106 can have multiple light units 128 facing toward the open front 176 of the housing 110. The light units 128 can be light-emitting diodes (LEDs), laser diodes (LDs), or other types of lights known in the art. The light units 128 can be connected to a circuit board such as a printed circuit board 108. The printed circuit board 108 can in turn be attached to a light unit panel seat 109 that holds the printed circuit board 108 in the housing 110.

The light module 106 can further include a lens cover 150 (e.g., of transparent plastic) that overlays at least a portion of the printed circuit board 108 and light units 128. The lens cover 150 can have individual lenses located in registry with the light units 128. Each of the lenses can gather the light emitted by the corresponding light unit 128, such that the light from the light units 128 are transformed into parallel light beams after passing through the lenses in lens cover 150. A film slide 148 can be mounted on top of, or distal to, the lens cover 150. The film slide 148 can contain negative images **148*a* that are located in registry with the light units, such that light emitted by the light units 128 projects the images toward the cover 102. According to embodiments, the film slide 148** can include multiples of the same image, or a set of different images. Possible images can include snowflakes, a pumpkin, a ghost, a witch, or other festive images.

As seen in FIG. 2, the light module 106 can further include multiple cone protrusions 170 extending rearward from the light unit panel seat 109. The cone protrusions 170 can correspond in radial position to the light units 128, such that a cone protrusion 170 is located in registry with each of the light units 128 (FIG. 3). Referring to FIGS. 2 and 3, each cone protrusion 170 can include an inlet and an outlet formed through opposite ends of the cone protrusion 170. Each of the light units 128 can be inserted into the inlet of one of the cone protrusions 170. The inlet of the cone protrusions can receive a portion of a light cup **186*a*, as explained below. The cone protrusions 170 can condense the light emitted by the light units 128**.

The light module 106 can include a light reflection cup panel 186 that can define one or more light cups **186*a* for containing the light units 128. In an embodiment, the reflection cup panel 186 can be mounted to light unit panel seat 109. In some embodiments, the light cups 186*a* of the reflection cup panel 186 can define holes that allow for each light unit 128 to fit at the proximal end of each light cup 186*a*. In an embodiment, the reflection cup 186 can be positioned between the light units 128 and the convex lenses 134**.

The decorative light can further include a heat dissipation plate 184 that can absorb heat emitted from the light units 128. In some embodiments, the heat dissipation plate 184 can include a substantially circular base and can be made of aluminum. The heat dissipation plate 184 can include arms 182 extending outwardly from a circumference of the base. The arms 182 can interlock with arm extensions 122 on the light unit panel seat 109.

Each of the lenses in lens cover 150 can be mounted in the outlet of one of the cone protrusions 170. According to an embodiment, each of the lenses can comprise a convex lens, having its convex surface directed toward the open front 176 of the housing 110 in the assembled state. According to an embodiment, the light module 106 has five light units 128, five cone protrusions 170, and the lens cover 150 has five lenses, all arranged in registry with one another, however, other quantities are possible. As shown in FIG. 3, the light module 106 can comprise five light units 128, with four light units 128 distributed evenly around a central one of the light units 128, however, other arrangements are possible. According to an embodiment, the lenses in lens cover 150 can be disposed on the same plane, which can be substantially orthogonal to the longitudinal axis of the housing 110. In an embodiment, the plurality of lenses can include five lenses, however, other quantities are possible.

The light unit panel seat 109 can include arm extensions 122 that extend toward the open front 176 of the housing 110, and can serve as structural members to mount the light module 106 in the housing 110, and/or to support other components, as will be described in more detail below. The light unit panel seat 109 can further include mounting bosses 172, 174, which can be utilized to mount the light module 106 within the housing 110, e.g., using fasteners, adhesives, snaps, or other techniques to connect the bosses 172, 174 to the housing 110.

As mentioned previously, the light units 128 can be electrically connected to the circuit board 108 and can be controlled by a control unit contained in the circuit board 108. In some embodiments, the light units 128 can be surface mounted LEDs that can be mounted on the surface of the printed circuit board 108. Each of the light units 128 can emit white light. Alternatively, each of the light units 128 may be a three-color LED unit that selectively emits light beams in different colors, such as blue, red, green, and so on. According to embodiments, the control unit of the circuit board 108 can control blinking of the light units 128 and/or the color of the light beams, so as to form marquee lighting effects using various combinations and illumination patterns of the red, blue, and green light beams.

The printed circuit board 108 can be shaped and oriented as a diamond within the housing 110 so as to fit snugly within the arms 122 of the heat dissipation plate 184. For example, as shown in FIG. 3, opposing arms 182 at a lower portion of the dissipation plate 184 can extend with an orientation of a V-shape with respect to a radial axis of the housing 110. However, the same diamond-shaped fit can be achieved at other orientations of the dissipation plate 184 such as at the top (up-side down V-shape), to the left (left arrow shape), to the right (right arrow shape), or other orientations. The printed circuit board 108 can have a pair of opposing parallel edges 108*a* at a center height. Opposing arms at the center height of the heat dissipation plate 184 can be parallel and thus be shaped to border the contours of at least a substantial portion of the opposing parallel edges 108*a* of the printed circuit board 108.

The light module 106 can be electrically connected with the power supply 180 (e.g. via wires or other conductors) so that the power supply 180 provides electric power to the components of the light module 106, e.g. the circuit board 108 and the light units 128.

Still referring to FIGS. 2 and 3, the power supply 180 can comprise an AC/DC power supply. The power supply 180 can include a power converter and a power supply board 132 located therein. The power supply board 132 can be a DC power converter that converts AC power supplied from the power cable 154 into DC current. The power supply board 132 can be electrically connected with power cable 154, which can extend to the exterior of the decorative light 100, for example, via weatherproof port 156, to be connected with a conventional 110V AC power receptacle. A power supply housing 130 can be provided to contain power supply board 132. Bracket 158 can be located within housing 110, and can compress a rubber grommet (not visible) that extends around cable 154, to further provide a weatherproof seal where the power cable 154 extends through the housing 110.

Although not specifically shown, in an alternate embodiment, the power supply board 132 can be electrically connected to a conventional light-bulb "base" (such as a threaded base) so that the decorative light can be connected directly to the socket of an existing lighting fixture. The power supply board 132 can receive AC current and convert it to DC current for supply to the components of the decorative light 100, such as the motor 104 and the circuit board 108. According to an alternative embodiment, the motor 104 and/or light units 128 can operate based on the AC power provided by the source. The power supply 180 can be located entirely or partially in the inner space of the housing 110.

Once powered, the motor 104 can be energized, causing the motor output shaft 124 to rotate. The motor output shaft 124 can be configured to fit inside an aperture, such as hole 185 in the heat dissipation plate 184, which allows the output shaft 124 to rotate freely. Rotation of the motor output shaft 124 can drive the heat dissipation plate 184, which in turn can rotate gear 138 attached thereto, as will be explained in more detail below.

Referring to FIG. 3 in conjunction with FIG. 2, the decorative light 100 can include a rotating lens module 178 located between the light module 106 and the cover 102, and a stationary lens module 121 located between the light module 106 and the cover 102. Referring to FIG. 3, the rotating lens module 178 can include one or "rotating" lenses 134, which can comprise convex lenses having their convex surface directed toward the open front 176 of the housing 110 in the assembled state. According to the embodiment shown, the stationary lens module 121 can include a plurality of "stationary" lenses 142 arranged in series. The stationary lenses 142 can comprise convex lenses having their convex surface directed toward the open front 176 of the housing 110 in the assembled state. According to an embodiment, spacers can be used to distance adjacent lenses 142 apart from one another. The one or more intermediate lenses 142 can fit inside a substantially cylindrical (e.g., tube-like) outer lens housing 114, shown herein as parts 114*a* and 114*b* that join together. The stationary lens module 121 can be located centrally with respect to the rotating lens module, such that the rotating lenses 134 are distributed radially about the stationary lenses 142.

The stationary lens module 121 can be disposed in a substantially central radial position with respect to the light module 106. According to an embodiment, one of the light units 128 can also be substantially centrally disposed, such that the centrally-located light unit 128 is substantially in registry with the center of the stationary lens module 121. Mounting tabs 115 can be provided on the outer lens housing 114, and can be used to mount the stationary lens module 121 onto the light module 106, for example, on top of film 148.

As shown in FIG. 3, the decorative light 100 can include a waterproof ring 101 that can be sized and shaped to snugly fit around the cover 102. The waterproof ring 101 can be disposed in between the cover 102 and the housing 176 to form a weatherproof seal.

Still referring to FIGS. 2 and 3, the rotating lens module 178 can be located between the light module 106 and the cover 102. The rotating lens module 178 can include "rotating" lenses 134, which can comprise convex lenses having their convex surface directed toward the cover 102. The plurality of lenses 134 can be disposed on the same plane. In an embodiment, the rotating lens module 178 can include six lenses 134, however, different quantities are contemplated within the invention. The lens housing 118 can define a space that can receive each of the lenses 134, for example, using a snap fit and/or adhesives. The lens housing 118 can define a plurality of apertures, each substantially corresponding to an perimeter of one of the lenses 134. The lens housing 118 can also have a central aperture, as discussed below. In an embodiment, the lens housing 118 can define six apertures for reception of the lenses 134, surrounding a central aperture. The lenses 134 can be formed as a single piece or as individual lens units. According to an embodiment, the radially central aperture can be in the same line of sight as the stationary lens module 121, to permit some or all of the light emitted from the stationary lens module 121 to pass through the central aperture uninterrupted.

The lens housing 118 can include gear teeth 116 disposed about its periphery. The rotating lens module 119 can further include a rotating lens housing unit, comprising first and second members 136, 152, fixed to the housing 110. The first and second members 136, 152 can sandwich the lens housing 118. Idler gears 138*b* can be sandwiched between the first and second members 136, 152 (e.g., mounted to support posts). The idler gears 138*b* can interface with the gear teeth 116 on the perimeter of the lens housing 118, and can provide for rotation of the lens housing 118 (and the lenses 134 coupled thereto) with respect to the rotating lens housing unit. An input gear 138*a* can be coupled to the output shaft 124 of motor 104 (e.g., using a key-fit), and can be meshed with the gear teeth 116. Accordingly, when the motor 104 is energized, rotation of the output shaft 124 can drive the input gear 138*a* to impart rotation to the lens housing 118 and associated rotating lenses 134. Meanwhile, the stationary lens module 121 can remain stationary within housing 110.

The decorative light 100 can provide a combination of static and dynamic imagery. As the output shaft of motor 104 rotates, input gear 138*a* engages gear teeth 116 on lens housing 118 to rotate the rotating lenses 134. At the same time the motor 104 imparts rotation to the rotating lenses 134, the light units 128 can be illuminated. Light projected by the centrally-located light unit 128 can sequentially pass through the associated cone protrusion 170, light cup 186*a*, lens in lens cover 150, negative image on film 148, and through the stationary lens module 121. The image projecting from the stationary lens module 121 can then pass through the central aperture in the lens housing 118 (where, according to embodiments, no lens is located). Subsequently, the image from the stationary lens module 121 is projected through the front cover 102 and into the ambient environment. As such, an enlarged, static version of the central negative image on the film 148 can be projected into the environment.

At the same time this occurs, the peripheral light units 128 can sequentially project light through their associated cone protrusions 170, light cups 186*a*, lenses in lens cover 150, and negative images on film 148. The light units 128 distributed peripherally around the intermediate lens module 121 can emit light that bypasses stationary lens module 121, and instead projects through the rotating lenses 134. Subsequently, the light passes through front cover 102 and into the ambient environment. This can cause the light passing through the peripheral negative images on the film 148 to have a dynamic (e.g., moving) visual effect. For example, the dynamic lighting effects can projected against the backdrop of the static image projecting through the stationary lens module. For example, according to an embodiment, the projecting visual effect may resemble snowflakes drifting in the sky. Alternatively, the projecting visual effect may resemble snowflakes gathering inward and then expanding outward. According to other embodiments, the projecting visual effect may resemble ghosts flying through the air. Therefore, an effect can result where the middle image on the film 148 can become the projected background while the peripheral images on the film 148 are floating. As such, the decorative light 100 can thus project a combination of both static and dynamic images.

According to embodiments, the light units 128 on the radial periphery of the light unit 106 can be high brightness LEDs, and can emit stronger parallel light through the reflection cup 186 and convex lenses 150, projecting the images 148*a* of the film 148 into the environment.

Different image effects can be achieved by replacing the film 148 with different films containing different images and combinations of images. The images can be projected in different colors by altering the color of the light units 128. Additionally, according to embodiments, the light units 128 can emit lights in different colors or patterns. For example, one or more of the light units 128 can emit light of a different color than the remainder of the light units 128. Additionally, one or more of the light units 128 may blink in a regular or random manner.

The decorative light 100 can include a stand 60 (also referred to interchangeably herein as a "grounding stick") connected to a bottom, exterior surface of the housing 110, for example, using a ball-and-socket joint 62, 64 or other articulating or fixed connection method known in the art. The stand 60 can be used to support the light 100 above a surface, for example, such as yard, patio, or driveway. Additional details about an embodiment of the stand 60 are provided below in connection with FIGS. 12 and 13.

Second Embodiment

Figure 4:
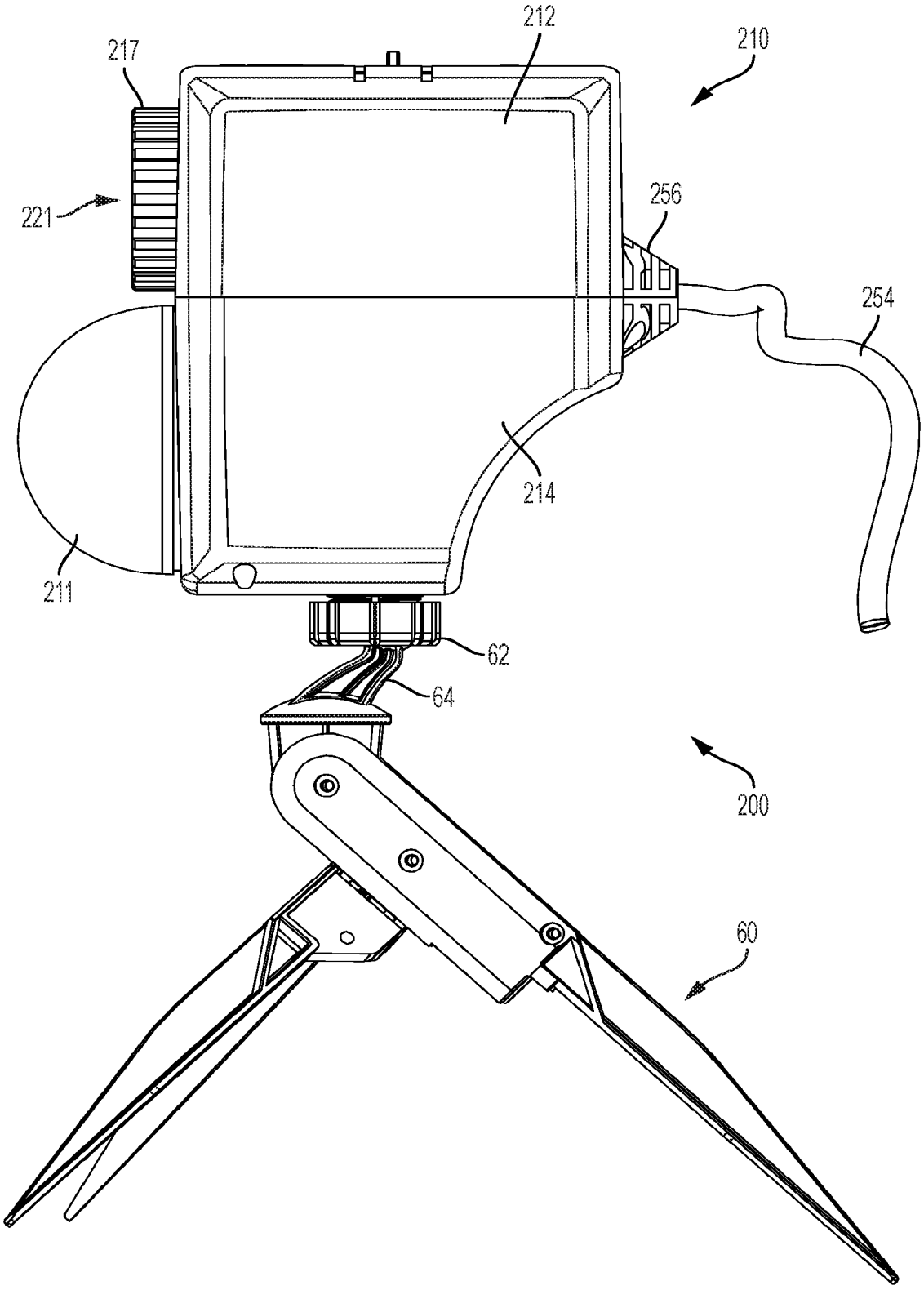
FIG. 4 is a side view of a second embodiment of a decorative light.
Figure 5:
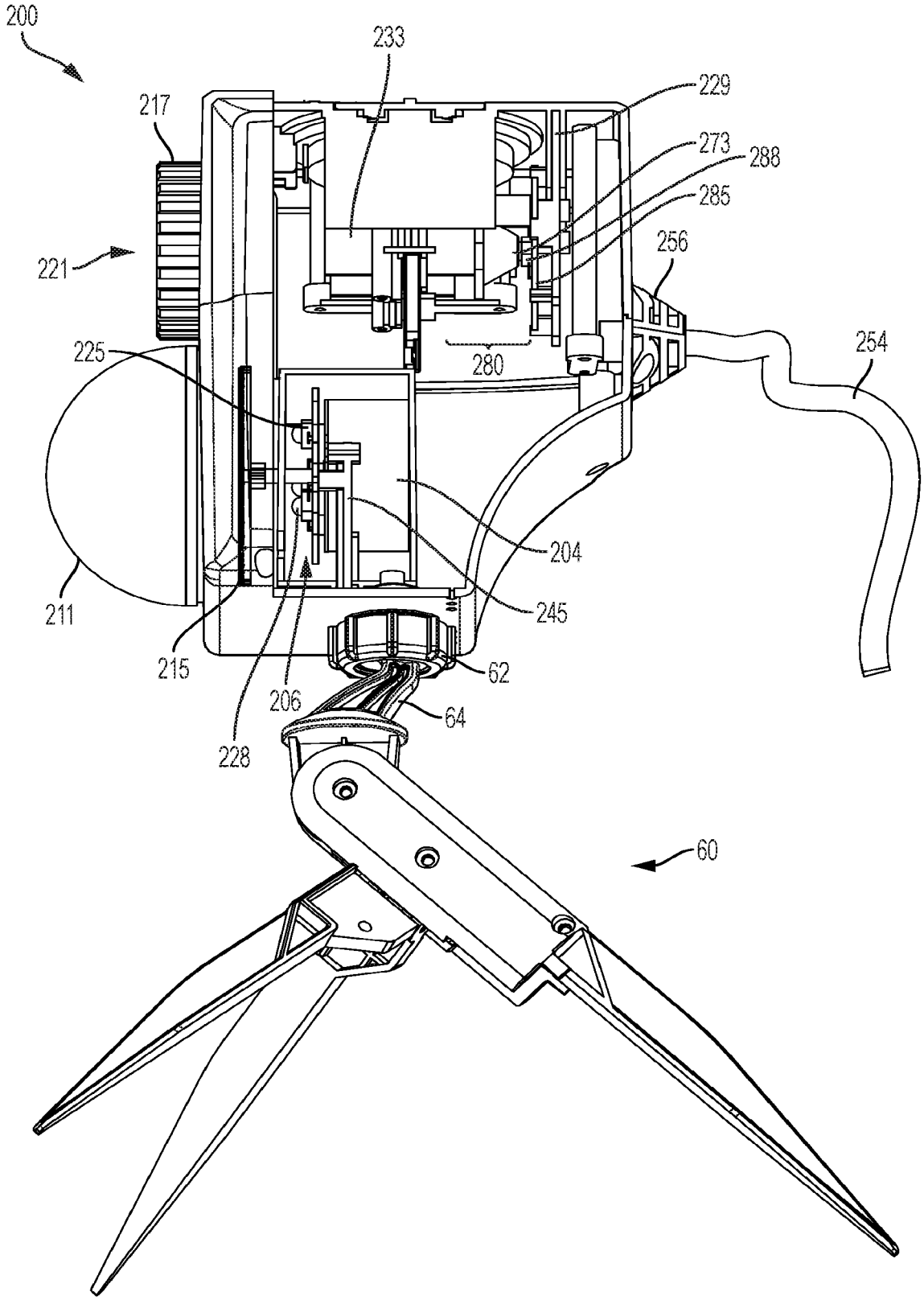
FIG. 5 is a side-perspective view of the decorative light of FIG. 4, shown with portions removed.
Figure 6:
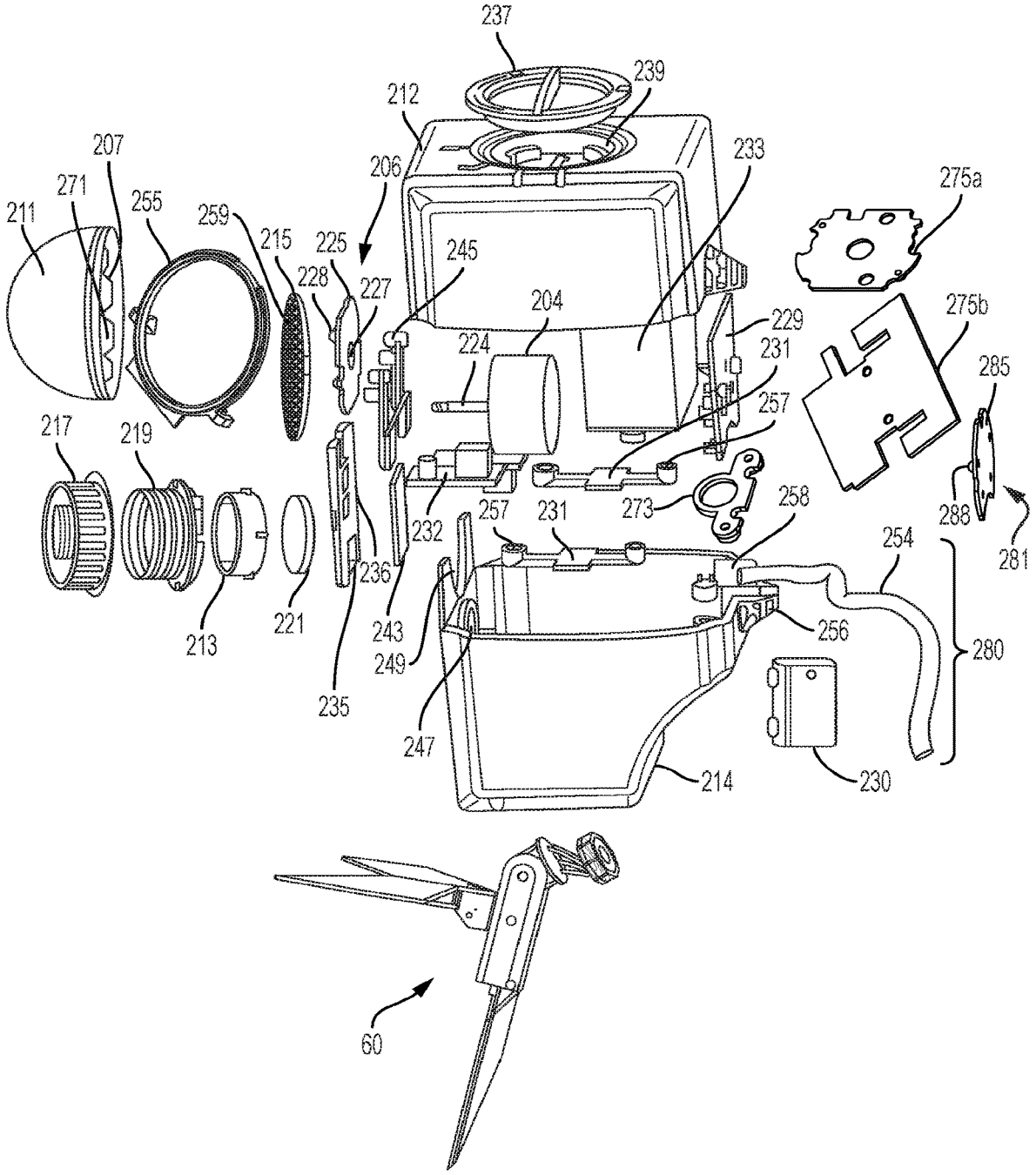
FIG. 6 is an exploded view of the decorative light of FIG. 4.

A second embodiment of a decorative light 200 is shown in FIGS. 4 to 6. FIG. 4 is a side view of the decorative light 200. FIG. 5 is a side-perspective view of the decorative light 200, shown with portions of the housing removed to illustrate internal components. FIG. 6 is an exploded view of the decorative light 200. As shown in FIG. 4, the decorative light 200 can include a housing 210, a stand 60 connected to the housing 210, a front cover 211, a focusing lens 221 connected to the housing (e.g., via a focusing dial 217), and a power cable 254 that can be used to supply electrical power (e.g., from an 110V AC power outlet) to the electrical components of the light 200. The housing 210 can include an upper housing 212 and a lower housing 214 that connect together in a clamshell-like manner (e.g., using fasteners, adhesives, snaps, or the like) to enclose a hollow interior portion. The decorative light 200 can project light from both the front cover 211 and the focusing lens 221 as will be described in more detail below. Accordingly, the front cover 211 and/or focusing lens 221 can be transparent or translucent, or otherwise formed of a material that permits light to shine through. Further details about an embodiment of the stand 60 are provided below in connection with FIGS. 12 and 13.

Referring to FIGS. 5 and 6, the internal components of the decorative light 200 can be seen. The light 200 can include a power supply 280 that supplies electrical power to the electrical components of the decorative light 200 (e.g., using wires or other conductors). With reference to FIG. 6, the power supply 280 can include a power box 230 mounted at least partially in the housing 210. The power supply can receive AC power from the power cable 254, and provide a DC power source to various components of the light 200, e.g., through wires or other conductors. The power box 230 can comprise a power supply board 232 that can be electrically connected with cable 254. In turn, cable 254 can extend to the exterior of the decorative light 200, for example, via weatherproof port 256 and rubber grommet/brackets 258, to be connected with a conventional 110V AC power receptacle. Although not specifically shown, in an alternate embodiment, the power supply 280 can be electrically connected to a conventional light-bulb "base" (such as a threaded base) so that the decorative light can be connected directly to the socket of an existing lighting fixture.

The decorative light 200 can include components that cooperate to project light along first and second optical pathways that are laterally offset from one another. As explained below, the first optical pathway can comprise components that project a dynamic lighting effect. For example, the decorative light can include a motor 204 (such as a DC electric motor) having an output shaft 224 with a multi-surface refractive lens 215 connected thereto (e.g., using a key-fit or other structure). The components can further include the front cover 211, as well as a first light module 206 disposed between the motor 204 and the refractive lens 215. As can be seen from FIG. 5, these components can be arranged along a common optical path, such that light from the first light module 206 is projected through the refractive lens 215 and the front cover 211.

The motor 204 and first light module 206 can be mounted in the housing 210 in a stationary manner, for example, using mounting bracket 245 (see, e.g., FIG. 5). The motor 204 can be electrically connected with the power supply 280. The motor 204 can be actuated to rotate the output shaft 224 and the refractive lens 215 attached thereto. The refractive lens 215 can comprise a multi-surface lens having a plurality of multi-angle refractive lens elements 259 formed on the side of the lens 215 that is facing the front cover 211.

As mentioned previously, the first light module 206 can be mounted in the housing 210 between the motor 204 and the refractive lens 215. Referring to FIG. 6, the first light module 206 can include a circuit board 225 and multiple light units 228, such as light emitting diodes (LEDs) or laser diodes (LD), electrically connected thereto. According to embodiments, the light units 228 can comprise three high high-brightness LEDs. The circuit board 225 can define an aperture 227 through which the output shaft 224 of the motor 204 projects, permitting the circuit board 225 and associated light units 228 to remain stationary while the output shaft 224 and refractive lens 215 rotate with respect thereto. The circuit board 225 can be electrically connected with the power supply 280. The light units 228 of the first light module 206 can be controlled by the circuit board 225 to emit light in different modes, such as a flicker mode or a normal mode. The light units 228 can be mounted on a side of the circuit board 225 that faces the refractive lens 215, such that, during operation, light emitted by the light units 228 is directed through the rotating refractive lens 215. The two elements 231 in FIG. 6 can have screw through-holes 257 which can be used to fix a power box 230 inside the upper housing 212.

The front cover 211 can be mounted over an aperture 247 (partially visible in FIG. 6) in the housing 210, for example, using fasteners, adhesives, or a snap connection. The front cover 211 can be substantially hemispherical in shape, as shown. According to embodiments, the front cover 211 can comprise a beam splitter. According to embodiments, the front cover 211 can comprise a large aperture lens 207, which can be a kaleidoscope lens and can include a plurality of multi-angle refractive convex-lens bodies 271 distributed over the interior surface of the front cover 211 (e.g., facing the refractive lens 215). The large aperture lens 207 can be a Fresnel lens. A weatherproof washer, gasket, or other similar part can be mounted between the front cover 211 and the housing 210 to keep moisture from entering the interior of the housing 210. For example, a sealing ring or gasket 255 can be provided at the interface of housing 210 and front cover 211. During operation, light emitted by the first light module 206 passes through the rotating refractive lens 215 and the front cover 211, into the ambient environment to create a dynamic lighting effect.

The decorative light 200 can include components that cooperate to project light along a second optical pathway that creates a static, or partially static, lighting effect. These components can include a second light module 281 electrically powered by the power supply 280, a large aperture lens 243 such as a Fresnel lens, a film slide 235, and a focusing lens 221 (e.g., a convex lens), arranged sequentially. The second light module 281 can be mounted stationary in the housing 210, for example, using bracket 229. The second light module 281 can include a circuit board 285 having one or more light units 288, e.g., light emitting diodes (LEDs) or Laser Diodes (LDs), electrically connected thereto. The embodiment shown has just one light unit 288, however, other quantities are possible. According to embodiments, the second light units 288 can each comprise a 3 watt LED. The light units 288 can be located in registry with the input end of a light cup 273, similarly to the cone protrusions 170 of the first embodiment. The circuit board 285 can be electrically connected with the power supply 280. The light units 288 of the second light module 281 can be controlled by the circuit board 285 to emit light in different colors and/or modes. The light cup 273 can have output ends that project the light from the light unit 288 through the large aperture lens 243, slide 235, and focusing lens 221. The light cup 273 can disperse the light from light unit 288 to avoid a bright spot formed in the center of the projected light. According to embodiments, a structure 233, such as an opaque or transparent housing, can be used to house and protect the motor 204. The film slide 235 can be mounted within the housing on a slide plate 236. According to embodiments, the slide plate 236 can be a film clamping piece configured to house a piece of film inside.

The decorative light 200 can include cooling fins **275*a*, 275*b* that facilitate cooling of the internal components. The cooling fins 275*a*, 275*b* can act as dissipating heat panels. For example, cooling fin 275*a* can be disposed directly behind circuit board 225 of the first light module 206 in the assembled state such that heat emanating from the circuit board 225 can be transferred to the cooling fin 275*a*. The cooling fin 275*a* can have a substantially similar planar surface as the circuit board 225. Similarly, cooling fin 275*b* can be disposed directly behind circuit board 285 of the second light module 281. The cooling fin 275*b* can also have a substantially similar planar surface as the circuit board 285**.

The focusing lens 221 can be mounted to the side of the housing 210 opposite of the second light module 281. The focusing lens 221 can be located over an aperture (partially shown in FIG. 6 as 249) in the wall of the housing 210. The decorative light 200 can include a moving lens housing 219 and a focus lens cover 213 that mate together to hold the focusing lens 221. The moving lens housing 219 can be rotatably mounted within the aperture in the housing 210, and can be coupled to the focus dial 217, for example, in a threaded manner. Accordingly, rotation of the focus dial 217 can cause the moving lens housing 219 to move axially (e.g., due to engagement of corresponding mated threads) to move the focusing lens 221 in an axial direction, e.g., with respect to the large aperture lens 243. Accordingly, rotation of the focus dial 217 can adjust the focus of light exiting focusing lens 221, as is known in the art.

According to embodiments, lenses 243 and 207 can each comprise a Fresnel lens in different shapes and/or sizes. For example, lens 207 can comprise a curved or substantially semi-circular (e.g., dome) shape, while lens 243 can be substantially planar.

Referring to FIG. 6, the film slide 235 can include one or more negative images that are located in registry with the large aperture lens 243, such that light projecting from the large aperture lens 243 passes through the film slide 235 and casts the negative image contained thereon onto the focusing lens 221. According to embodiments, the film slide 235 can include multiples of the same image, or a set of different images. Possible images can include snowflakes, a pumpkin, a ghost, a witch, or other festive image.

When the decorative light 200 is in use, the components that cooperate to project light along the first optical pathway project a dynamic lighting pattern, while the components that project light along the second optical pathway simultaneously project a substantially fixed lighting pattern (which can be monochromatic or multi-chromatic). Light emitted from the second light unit 288 can pass through condensed light cup 273, large aperture lens 243, slide 235, and focusing lens 221 so as to form and project one or more static images. At the same time, the first light units 228 can emit white or colored light through the refractive lens 215 and large aperture lens 207 of the front cover 211. According to embodiments, the refractive lens 215 can comprise a corrugated lens panel. In use, refractive lens 215 is driven to rotate by the output shaft 224 of the motor 204. When light projects through the refractive lens 215, the light may be refracted again or may be further mixed to form light beams in various colors. The front cover can define a large aperture lens surface 207 including multiple multi-angle refractive convex lens bodies formed on its inner surface. Light beams (monochromatic or multi-chromatic) further pass through the multi-angle refractive convex-lens bodies 271 of the large aperture lens 207, and are further refracted outwards through the front cover 211. Therefore, the light beams refracted through the front cover 211 can project outwards at different angles covering a large area. According to embodiments, this can create the appearance of a colorful cloud. As a whole, the colorful cloud can form the background against which the static image(s) from the focusing lens 221 are projected.

Different image effects can be achieved by replacing film slide 235 with different film slides. Different background effects can be achieved by replacing the large aperture lens 207 with different large aperture lenses, or Fresnel lenses. Different colors of light can be achieved by replacing the light units 228 and 288 with differently colored lights, and/or by changing the color emitted by multi-color LED(s).

The decorative light can include a switch cover 237 removably disposed on a side of the housing 210. The switch cover can engage within an opening 239 in the housing, for example, using latch grooves and positioning ribs, as is known in the art. The switch cover 237 can be a waterproof cover, which can be rotated to remove the cover. When the cover 237 is removed, film slide 235 can be removed and replaced with a different film slide containing different image(s) and/or combinations of images. When the switch cover 237 is replaced and locked in position, it can prevent water and other outside elements from entering the housing 210.

The decorative light 200 can include a stand 60 connected to a bottom, exterior surface of the housing 210, for example, using a ball-and-socket joint 62, 64 or other articulating or fixed connection method known in the art. Additional details about an embodiment of the stand 60 are provided below in connection with FIGS. 12 and 13.

Third Embodiment

Figure 7:
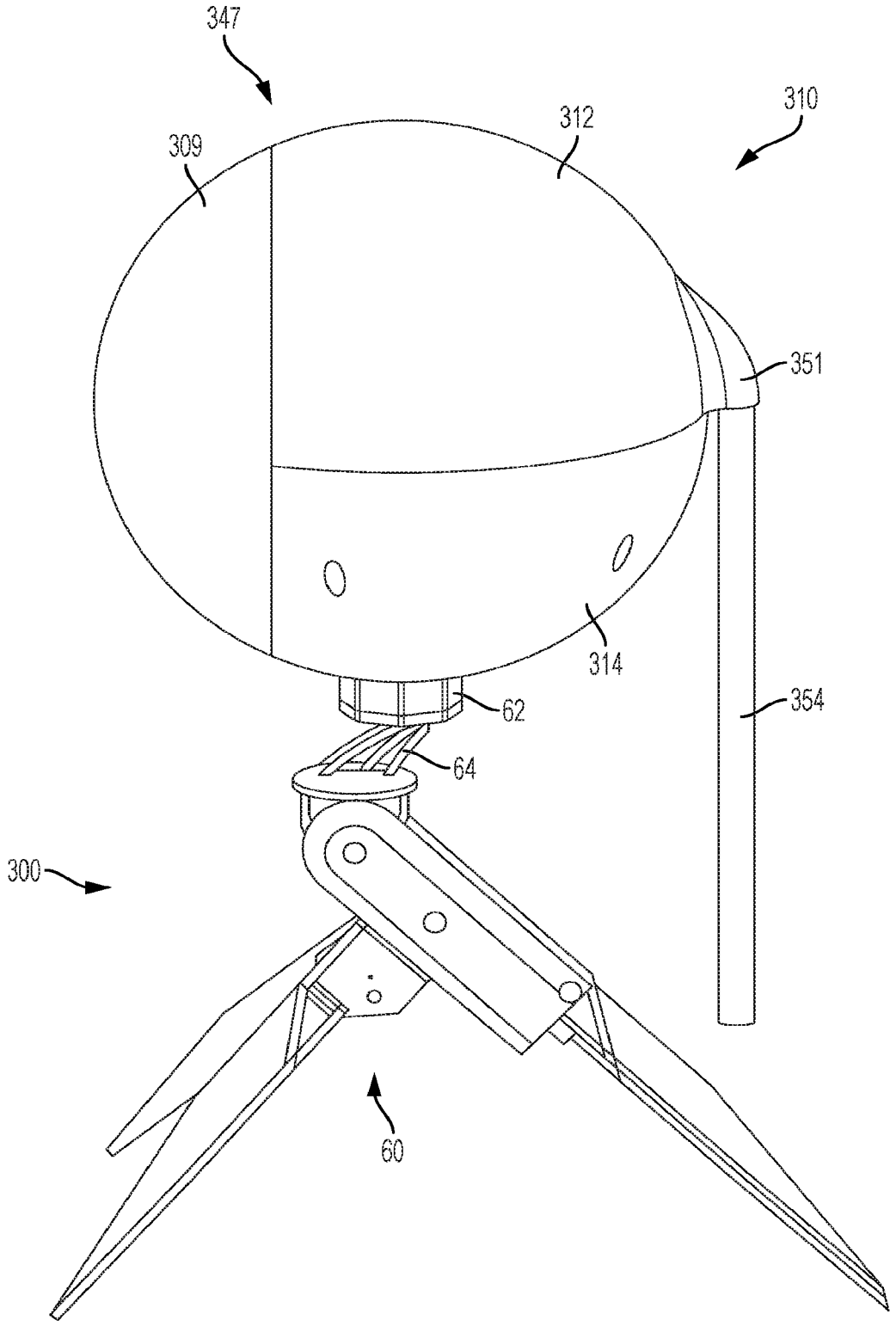
FIG. 7 is a side view of a third embodiment of a decorative light.
Figure 8:
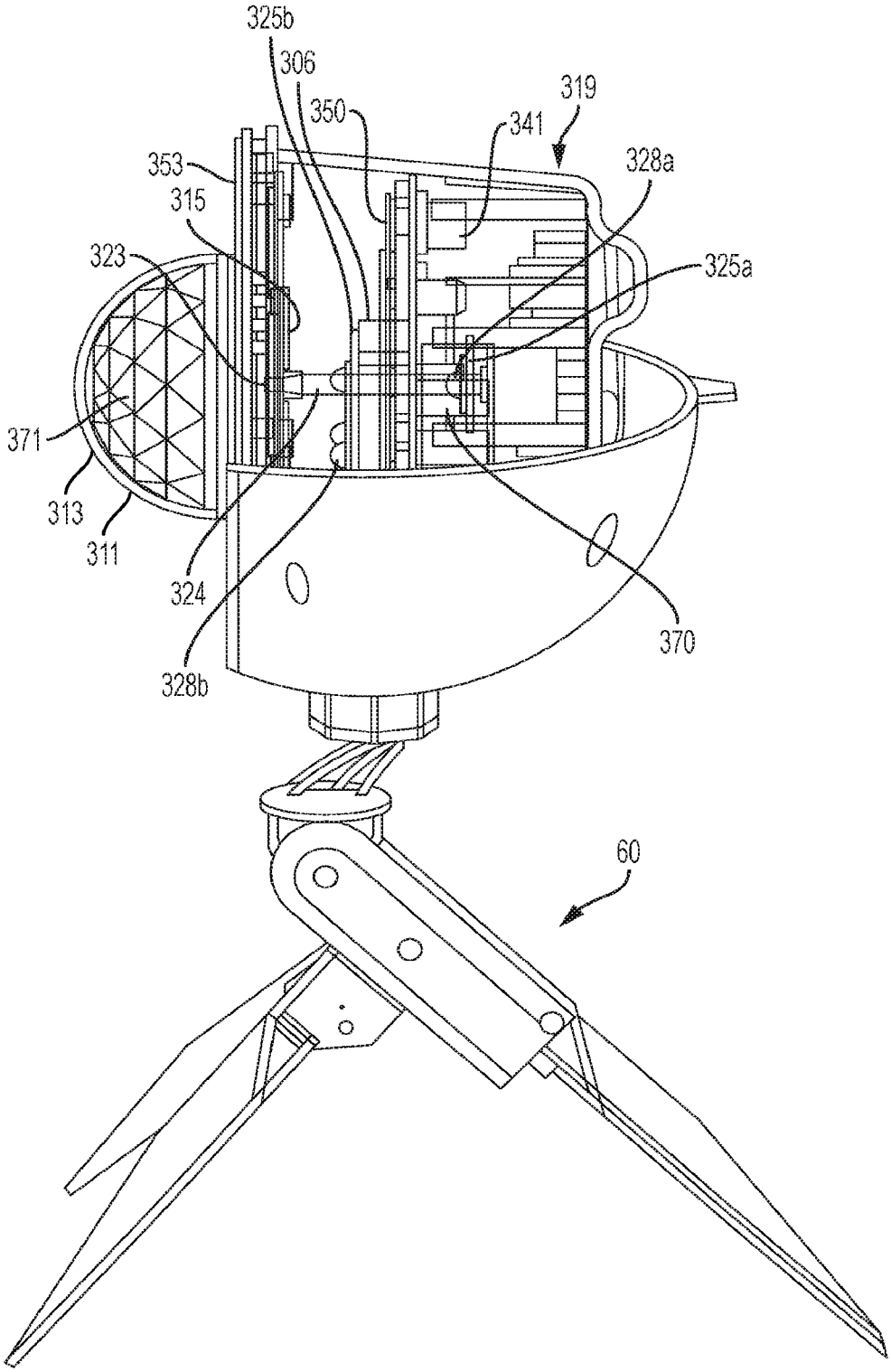
FIG. 8 is a side-perspective view of the decorative light of FIG. 7.
Figure 9:
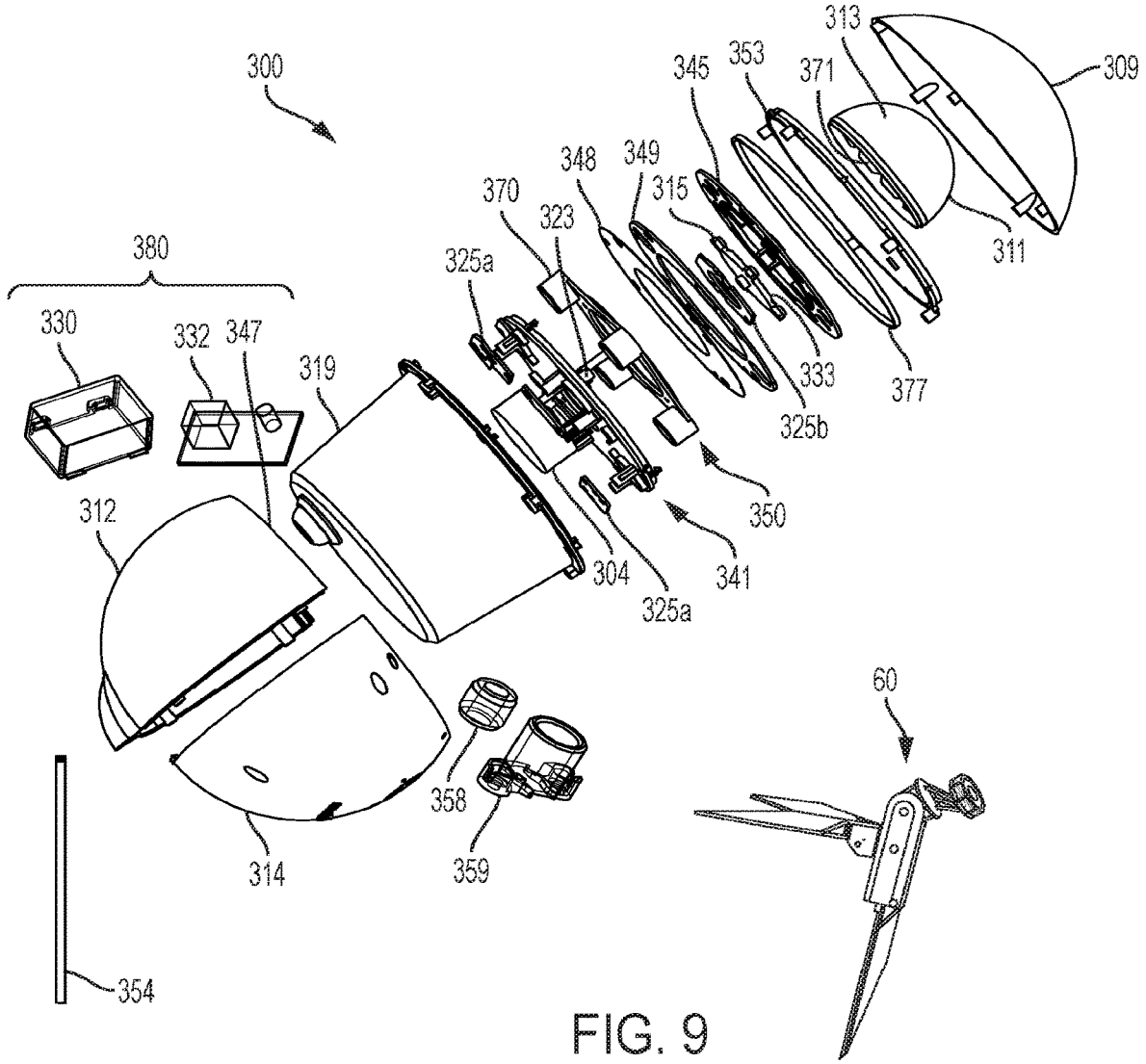
FIG. 9 is an exploded view of the decorative light of FIG. 7.

A third embodiment of a decorative light 300 according to the present invention is shown in FIGS. 7-11. FIG. 7 is a perspective view of the decorative light 300. FIG. 8 is a side-perspective view of the decorative light 300, shown with portions of the housing removed to illustrate internal components. FIG. 9 is an exploded view of the decorative light 300. As shown, decorative light 300 can include an outer housing 310 defining an interior space. As seen in FIG. 7, the outer housing 310 can be spherically shaped, however, other shapes are possible. The outer housing 310 can comprise a rear portion including halves 312, 314 secured together, for example, using fasteners, adhesive, or snap connectors. The rear portion can be formed from opaque material, such as plastic or metal, and can define an open front portion 347. A front cover 309 can be secured to the open front portion 347, for example, using fasteners, adhesive, or snap connectors. The front cover 309 can be transparent or translucent to allow for light to project from the interior space of the outer housing 310. The front cover 309 can be made of a durable material, such as hard plastic. A waterproof ring 377 (see FIG. 9) can be interposed between the front cover 309 and open front portion 347 to form a weatherproof seal with the outer housing. The waterproof ring 377 can be a gasket, rubber O-ring, or similar structure. According to embodiments, the front cover 309 can be a transparent semi-spherical shell.

Still referring to FIG. 7, the decorative light 300 can have a stand 60 coupled to the outer housing 310, for example, by a ball-and-socket joint 62, 64. The ball-and-socket joint 62, 64 if provided, can permit pivoting of the outer housing 310 with respect to the stand 60 in order to adjust the aim of the decorative light 300. One of ordinary skill in the art will appreciate based on this disclosure that other types of connections, including fixed connections, can be used to join the stand 60 to the outer housing 310. Further details of the stand 60 will be provided below in connection with FIGS. 12 and 13.

Referring to FIGS. 8 and 9, the decorative light 300 can include an inner housing 319 disposed inside the outer housing 310. A transparent or translucent inner cover 311 can attach to the open front of the inner housing 319. According to embodiments, the inner housing 319 and transparent inner cover 311 can be formed of durable plastic, and can be secured together using, for example, using fasteners, adhesives, or snap connectors. Light projected by the various internal components of the decorative light 300 project through the inner cover 311 and front cover 309 to the exterior of the light 300. The inner cover 311 can include a substantially smooth, planar lens portion 353 as well as a beam-splitter lens light shade 313 that projects from the planar lens portion 353. According to embodiments, the beam-splitter light lens shade 313 can be centrally located on the planar lens portion 353. According to embodiments, the beam-splitter lens light shade 313 can be a kaleidoscope lens having multi-angle refractive convex-lens bodies 371, e.g., located on an inner surface. As can be seen from FIGS. 8 and 9, the beam-splitter lens light shade 313 can be in the shape of a dome. The planar lens portion 353 and the lens light shade 313 can comprise a single monolithic unit, or alternatively, can comprise two or more parts joined together, for example, using adhesive or snap connectors.

Referring to FIG. 7, the upper rear half 312 of outer housing 310 can include a protrusion 351 that can serve as a conduit through which a power cable 354 extends. The power cable 354 can pass through the interior of the outer housing 310 and into the inner housing 319, for example, by a weatherproof seal on the inner housing 319. Referring to FIG. 9, the interior of the inner housing 319 can include a weatherproof seal where the power cable 354 enters from the outside. For example, the weatherproof seal can comprise a rubber grommet 358 or similar structure through which the power cable 354 passes. The rubber grommet 358 can be compressed around power cable 354 by bracket 359, and further secured to the inner housing 319 by bracket 359 to form a secure and weatherproof seal where the power cable 354 enters the outer housing 310. One of ordinary skill in the art will understand based on this disclosure that other structures can be used to form a weatherproof seal between the inner housing 310 and power cable 354. Further details of the power cable 354 will be provided below.

Referring to FIG. 9, a power supply 380 can be located in the inner housing 319. The power supply 380 can comprise an AC/DC power supply that can receive alternating current from a power source (e.g., via the power cable 354), and then convert the alternating current into a direct current. The direct current can then be supplied to various components of the decorative light 300 (e.g., via wires or other conductors), such as lights and motors, as will be described in more detail below. However, according to alternative embodiments, some or all of the electric components of the decorative light 300 can operate based on the AC power provided by the power source.

The power supply 380 can be located entirely or partially in the inner space of the inner housing 319. The power supply 380 can comprise one or more power supply boards 332 connected to the power cable 354. According to embodiments, one or more power supply boxes 330 can be provided to enclose and protect the power supply board(s) 332. As mentioned above, the power supply board(s) 332 can be electrically connected with power cable 354 for connection to a conventional 110V AC power receptacle. Although not specifically shown, in an alternate embodiment, the power supply board(s) 332 can be electrically connected to a conventional light-bulb "base" (such as a threaded base) so that the decorative light 300 can be connected directly to the socket of an existing lighting fixture.

The decorative light 300 can include a motor 304 located in the interior space of the outer housing 310, for example, a DC electric motor. The motor can be electrically coupled to the power supply 380, for example, using wires or other conductors. The motor 304 can include an output shaft 324 (see FIG. 8) that rotates when the motor 304 is supplied with power. The end 323 of output shaft 324 can be keyed to engage with a rotating lens module, as well be described in more detail below. Referring to FIGS. 8 and 9, the motor 304 can be coupled to the inner housing 319 by mounting bracket 341 using fasteners, adhesives, snap connectors, or the like. The mounting bracket 341 can in turn be coupled to the inner housing 319 in a similar manner.

The decorative light 300 can include first and second light modules that are secured within the inner housing 319 by mounting bracket 341. The first and second light modules can be electrically connected to the power supply 380, for example, using wires or other conductors. As will be described in more detail below, the components of the first and second light modules can define a central aperture such that the output shaft 324 of the motor 304 can pass freely there through (see, e.g., FIG. 8). More specifically, the first light module can comprise a plurality of first circuit boards 325*a* mounted to the mounting bracket 341. According to an embodiment, four of the first circuit boards 325*a* can be arranged in a circle, with the center of the circle aligned with the output shaft 324 of the motor 304. For example, each of the four first circuit boards 325*a* (and associated light units 328*a*, described below) can be spaced apart by approximately 90°, however, other quantities of the first circuit boards 325*a* and/or light units 328*a* and angular offsets are possible.

One or more first light units 328*a* (see FIG. 8), such as an LED or LD, can be provided on each first circuit board 325*a*. Each circuit board 325*a* can be electrically connected to the power supply 380 (e.g., using wires or other conductors) and can include a controller. According to the embodiment shown, one light unit 328*a* is provided on each first circuit board 325*a*.

The first light module can include a lens cover 350 that can be mounted on the mounting bracket 341. The lens cover 350 can house multiple lenses, with one lens being arranged in registry with each light unit 328*a*. The multiple lenses can be attached to the lens cover 350, or alternatively, can be part of the lens cover 350 (i.e., formed monolithically therewith). The first light module can further include multiple lens sleeves 370 extending rearward from the lens cover 350. Each lens sleeve 370 can correspond in radial position to one of the light units 328*a*, such that a lens sleeve 370 is located in registry with each of the light units 328*a*. As with the cone protrusion 170 described in previous embodiments, each lens sleeve 370 can include an inlet and an outlet formed through opposite ends of the lens sleeve 370. Each of the light units 328*a* can be inserted into the inlet of one of the lens sleeves 370. The lens sleeves 370 can condense the light emitted by the light units 328*a*.

Each of the lenses in lens cover 350 can be mounted in the outlet of one of the lens sleeves 370. According to an embodiment, each of the lenses can comprise a convex lens, having its convex surface directed toward the open front 347 of the housing 310. According to an embodiment, the first light module has four light units 328*a*, four lens sleeves 370, and the lens cover 350 has four lenses, all arranged in registry with one another and distributed evenly about the output shaft 324 of motor 304, however, other quantities and radial distributions are possible. According to an embodiment, the lenses in lens cover 350 can be disposed on the same plane, which can be substantially orthogonal to the longitudinal axis of the housing 310.

The first light module can further include a film slide 348 mounted over the lens cover 350, e.g., on the side facing the open front 347 of the housing 310. The film slide 348 can include a plurality of negative images that are located in registry with the light units 328*a* (e.g., four negative images), such that light projecting from each of the light units 328*a* passes through one of the negative images on the film slide 348 and casts the negative image contained thereon toward the open front 347 of the housing 310. According to embodiments, the film slide 348 can include multiples of the same image, or a set of different images.

Possible images can include snowflakes, a pumpkin, a ghost, a witch, or other festive image. The film slide 348 can be mounted to the front side of the mounting bracket 341 by slide plate 349. According to embodiments, the slide plate 349 can define an aperture in registry with each of the negative images on the film slide 348 (see FIG. 10). According to embodiments, the circumference of the apertures in the slide plate 349 can be the same size, or larger, than the circumscribed diameter of the respective negative image.

Figure 10:
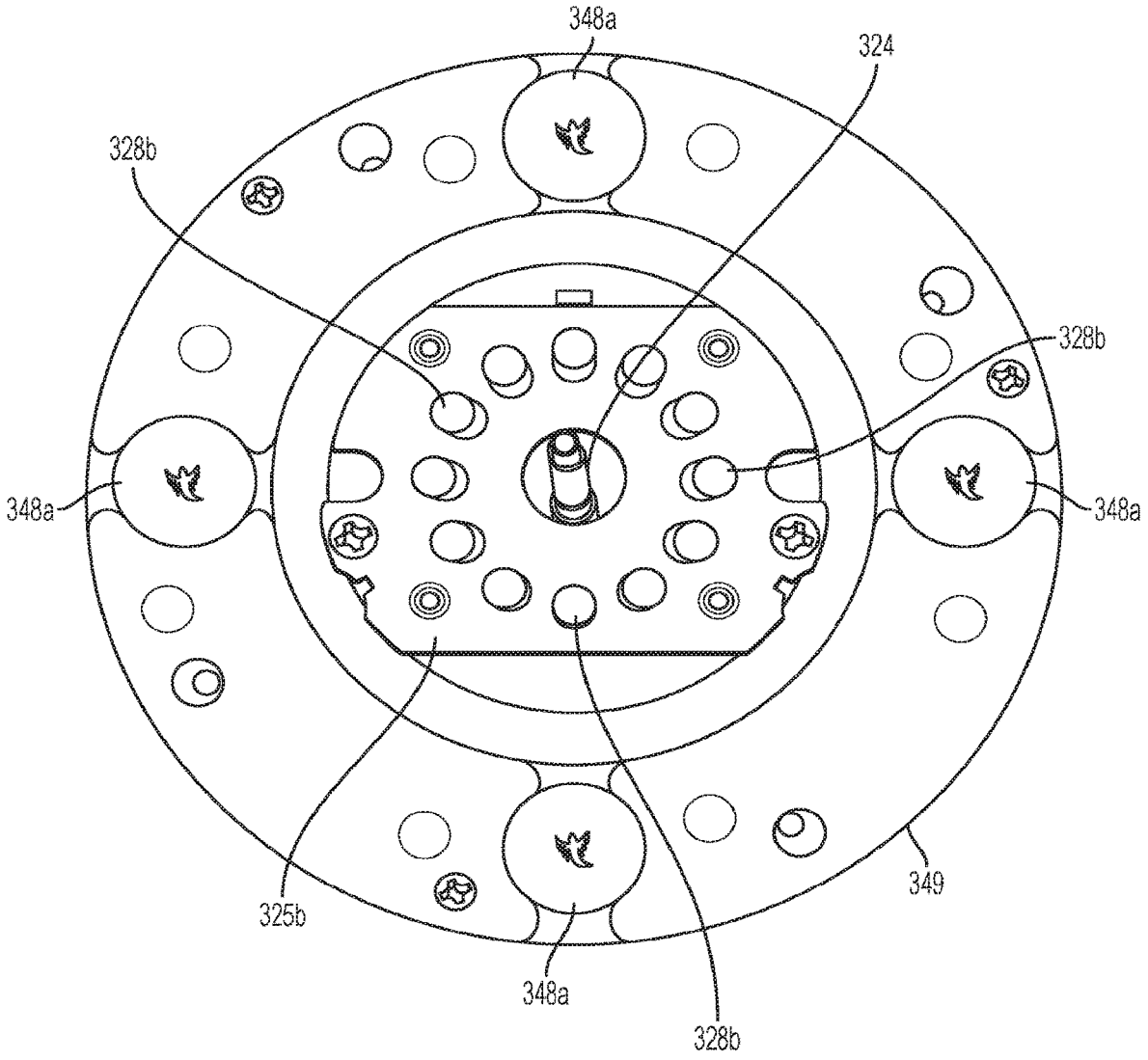
FIG. 10 is front view of an embodiment of the first and second light modules of the decorative light of FIG. 7.

The second light module can comprise a second circuit board 325*b* (e.g., a printed circuit board) having a plurality of light units 328*b* provided thereon (see FIG. 10). The second circuit board 325 can be electrically connected to the power supply 380, for example, using wires or other conductors. The second circuit board 325*b* can define a central aperture through which the output shaft 324 of the motor 304 passes (see FIG. 10). A plurality of the light units 328*b* can be distributed about the central aperture, for example, in a circular pattern. According to an embodiment, and as shown in FIG. 10, twelve light units 328*b* can be equally distributed in a circle that is concentric with the output shaft 324 of the motor. As shown in FIGS. 8 and 10, the light units 328*b* can be provided on the side of second circuit board 325*b* facing toward the open front 347 of the housing 310. According to embodiments, the second circuit board 325*b* can be connected to the mounting bracket 341 by one or more bosses 306 (see FIG. 8) extending forward from the mounting bracket 341, however, other configurations are possible.

FIG. 10 shows a front view of the first and second light modules, for example, when looking at the first and second light modules from the direction of the open front 347 of the housing 310. FIG. 10 depicts the four negative images 348*a* of the film slide 348 distributed in a circle about the output shaft 324 of the motor 304. As mentioned previously, a light unit 328*a*, lens sleeve 370, and lens from lens cover 350 can all be located in registry with each of the negative images 348*a* (e.g., extending downward into the paper of FIG. 10), such that light emitted by each light unit 328*a* passes through its respective lens sleeve 370, lens from lens cover 350, and negative image 348*a*. FIG. 10 also shows the slide plate 349 and the apertures through which the negative images 348*a* can project light.

Still referring to FIG. 10, the second light module is shown, including the second circuit board 325*b* and the plurality of light units 328*b* provided thereon. As shown, the plurality of light units 328*b* can be provided in a circle having its center aligned with the output shaft 324 of motor 304. As also shown, the negative images 348*a* of the first light module and the light units 328*b* of the second light module can be arranged in concentric circles, however, other arrangements are possible.

Figure 11:
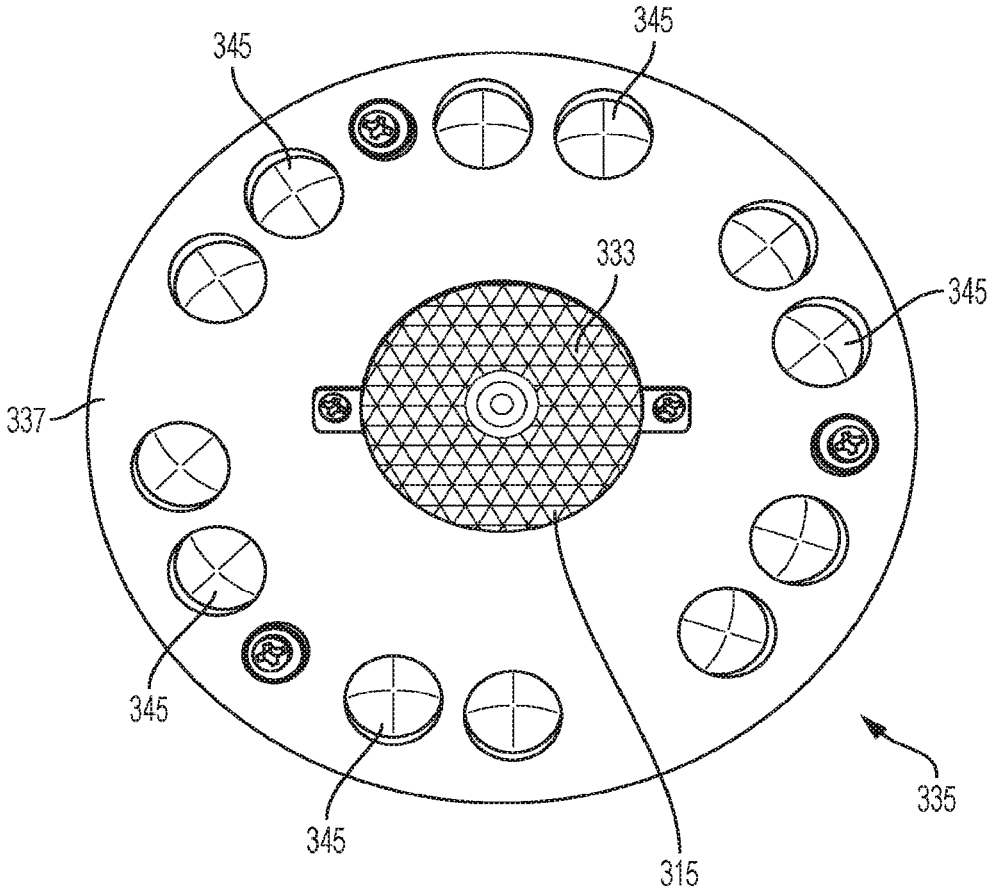
FIG. 11 is a front view of an embodiment of the rotating lens module of the decorative light of FIG. 7.

Referring to FIG. 11, the decorative light 300 can include a rotating lens module 335 through which light from the first light module passes. The lens module 335 can include a refractive lens 315 connected (e.g., keyed) to the end 323 of the output shaft 324 of motor 304, such that rotation of the motor 304 imparts rotation to the refractive lens 315. The refractive lens 315 can comprise a multi-surface lens having a plurality of multi-angle refractive convex-lens bodies 333 formed on the side of the lens 315 that is facing the front cover 309. The refractive lens 315 can be mounted at the center of slide plate 349. As shown in FIG. 11, the slide plate 349 can define a plurality of cutouts distributed evenly about the refractive lens 315. A rotating lens 345 can be located within each of the cutouts, such that the rotating lens module 335 includes a circular array of rotating lenses 345 arranged concentrically about the central refractive lens 315. According to embodiments, twelve rotating lenses 345 can be arranged concentrically about the central refractive lens 315, however, other quantities are possible. In other words, as shown in FIG. 11, when looking at the rotating lens module 335 from the direction of the open front 347 of the housing 310, the rotating lenses 345 can be seen arranged in a concentric circle about the centrally located refractive lens 315. The refractive lens 315 can be larger than each of the rotating lenses 345, however, other configurations are possible. According to embodiments, the rotating lenses 345 can comprise convex lenses 345 have their convex side oriented toward the front cover 309, however, other configurations are possible.

According to an embodiment, the light units 328*b* of the second light module can be arranged in a circle that is concentric with the refractive lens 315, and that has a diameter the same size as, or smaller than, the refractive lens 315. The refractive lens 315 and circle of light units 328*b* can also be concentric with, and of approximately the same diameter as, the beam-splitter light lens shade 313. Accordingly, some or all of the light projected by the light units 328*b* can project through the refractive lens 315 and the beam-splitter light lens shade 313. According to embodiments, the refractive lens 315 can comprise a Fresnel lens that has a corrugated surface.

Referring to FIGS. 10 and 11, the negative images 348*a* of the first light module can be arranged in a circle that is concentric with the circle containing the rotating lenses 345 of the rotating light module 335, and that has a diameter substantially the same size as the circle containing the rotating lenses 345. Accordingly, light projected from the light units 328*a* can project through the respective negative images 348*a* and then pass through the rotating lenses 345 passing above them. The light units 328*a* and rotating lenses 345 can also be arranged along the same optical pathway as the planar lens portion 353 of the front cover 311, such that the light projected from the light units 328*a* through the negative images 348*a* and rotating lenses 345 passes through the smooth planar portion 353.

The light units 328*a* of the first light module can comprise high brightness LEDs that emit strong parallel light through lens sleeves 370 and lenses 345 (e.g., convex lenses), thereby projecting the images from film slides 348*a*. The light units 328*a* can illuminate in various colors and combinations of colors to project light through the respective negative image 348*a*. The negative images 348*a* then cast images onto the rotating lenses 345 rotating above them (under power of motor 304), creating the illusion that the images projected by the negative images 348*a* are moving, for example, in a rotating, swirling, or expanding/contracting pattern. In an embodiment as shown in FIG. 9, the light 300 can have 14 imaging convex lenses 345. In other embodiments, as shown in FIG. 11, the light 300 can have 12 imaging convex lenses 345. As a result of the rotation of the convex lenses 345, six images can be formed through the lenses and rotate in the environment.

The light units 328*b* of the second light module can comprise low power LEDs that emit light through the refractive lens 315. The light units 328*b* can illuminate in various colors and combinations of colors, such as red, blue, green, white, and combinations thereof. This light projects through the central refractive lens 315, which rotates under the power of the motor 304. The light subsequently passes through the light splitting lens bodies 371 of beam-splitter light lens shade 313, before exiting the front cover 309, producing light focusing from different angles which looks like a colorful cloud. The light units 328*b* can further blink in various patterns to further enhance the lighting effect created by the second light module. The first and second light modules operate simultaneously, creating, as a whole, a colorful cloud that forms the background around which the six images appear to float.

Different image effects can be achieved by replacing film slide 348 with different film slides. Different background effects can be achieved by replacing the refractive lens 315 with different large aperture lenses, or Fresnel lenses. Different colors of light can be achieved by replacing the LEDs with different colored LEDs.

Stand

Figure 12:
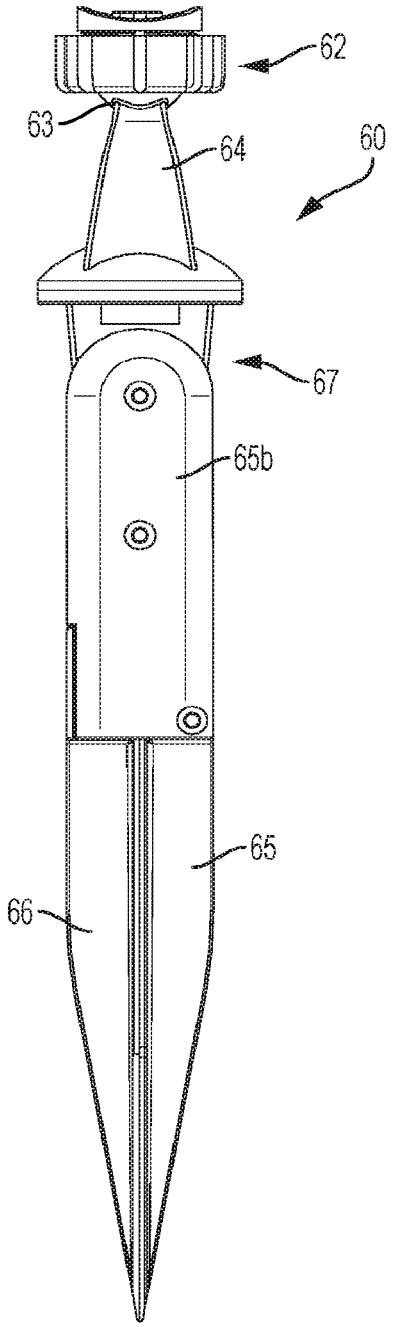
FIG. 12 is a front view of an embodiment of a stand, shown in a collapsed configuration.
Figure 13:
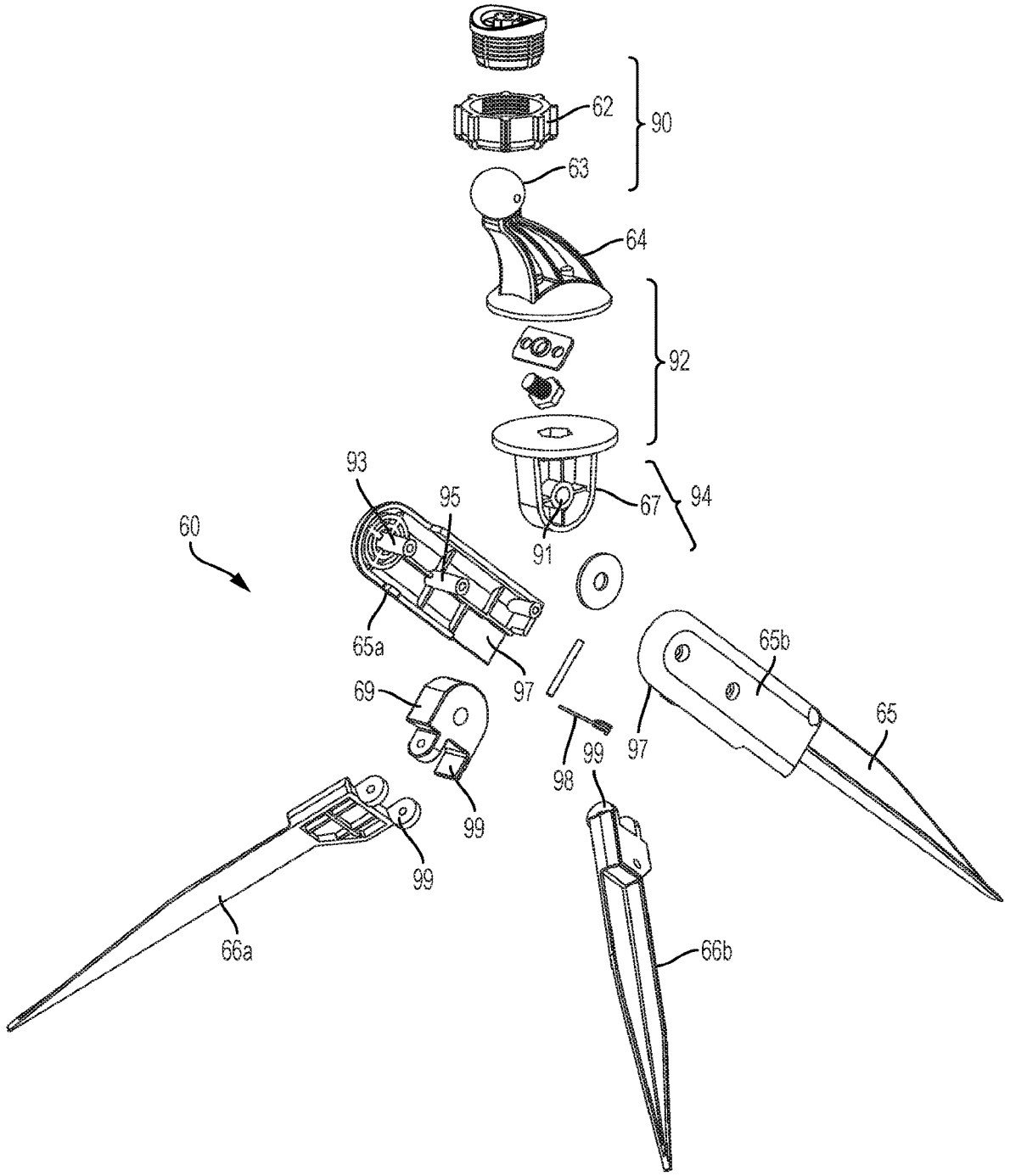
FIG. 13 is an exploded view of the stand of FIG. 12.

Referring to FIGS. 12 and 13, an embodiment of the support stand 60 is shown. Although the support stand 60 shown in FIGS. 12 and 13 can support the previously described and foregoing decorative light embodiments, the support stand 60 can alternatively be used to support another type of outdoor lighting product, or even another type of product altogether, such as a speaker, microphone stand, camera, or video recorder. The support stand 60 can convert between a collapsed configuration (see, e.g., FIGS. 1 and 12) and an expanded configuration (see, e.g., FIGS. 3, 4, 5). In the collapsed configuration, the support stand 60 can have the shape of a tapered post (or "spike" or "grounding stick") that can be implanted into the ground or other soft surface to maintain the support stand 60 and the outdoor product attached thereto in a stable, upright position. In the expanded configuration, the constituent parts of the tapered post can be expanded into a substantially tripod shape in order to support the support stand 60 and the outdoor product attached thereto in a stable position above the ground or a hard surface. Various components of the support stand 60 can be constructed from plastic, composite, metal, or other material known in the art.

Referring to FIGS. 12 and 13, the support stand 60 can include a head 90 (FIG. 13) that connects a support base 92 to the decorative light, for example, by connecting to a portion of the housing 110, 210, 310. For example, the head can include a ball joint utilizing a ball 63 and encapsulating nut 62 to provide adjustment of the decorative light with respect to the support base about multiple axes. One of skill in the art will understand, however, that other types of connections can be used to couple the support base to the decorative light.

The support stand 60 can also include a primary post 65, as well as first and second auxiliary posts 66A, 66B. The primary post 65 can be coupled to the head 90, and the auxiliary posts 66A, 66B can in turn be coupled to the primary post 65, as shown, however other configurations are possible. The primary post 65 and first and second auxiliary posts 66A, 66B fit together in a "collapsed position" to form the shape of a tapered post, or spike, as shown in FIG. 12. In this position, portions of the auxiliary posts 66A, 66B are substantially adjacent to the primary post 65, and extend substantially parallel to the primary post 65. As shown in FIG. 13, the primary post 65 can comprise first and second portions 65A, 65B that fit together, for example, in a clamshell configuration, and define a pocket 97 that can receive a portion of each of the auxiliary posts 66A, 66B. A pivot joint 94 can be located between the head 90 and the primary post 65 in order to provide additional adjustability. The pivot joint 94 can comprise a boss 93 secured through a bore 91 in the boss 67; however, other configurations are possible.

Referring to FIG. 13, the auxiliary posts 66A, 66B can move between the collapsed position and an "expanded position" (e.g., where they form a substantial tripod shape in conjunction with the primary post 65) using a multi-axis hinge mechanism. For example, the hinge mechanism can comprise a first hinge 69 connected to the primary post 65, e.g., via a boss 95. The first hinge 69 can pivot with respect to the primary post 65 about a first axis. A second hinge 99 can be located on the first hinge 69, and can connect the first and second auxiliary posts 66A, 66B to the first hinge 69. The second hinge 99 provides for pivoting of the auxiliary posts 66A, 66B about a second axis that is substantially perpendicular to the axis of the first hinge 69. Accordingly, the first and second auxiliary posts 66A, 66B can pivot with respect to one another between a position where they abut one another (e.g., when in the collapsed position), and a position where they are angled with respect to one another about the second hinge 99 (e.g., when in the expanded position). An elastic member, such as spring 98, can be associated with the second hinge 99 to normally bias the auxiliary posts 66A, 66B away from one another.

To position the support stand 60 in the collapsed configuration, the first and second auxiliary posts 66A, 66B are folded towards one another, e.g., about the second hinge 99 and against the force of the spring 98, until they abut one another. The auxiliary posts 66A, 66B are then rotated as a unit about the first hinge 69 until the combined auxiliary posts 66A, 66B abut the primary post 65. At this point, the support stand 60 is in the collapsed configuration. In this configuration, a portion of each auxiliary post 66A, 66B is received within the pocket 97 in the primary post 65, preventing the auxiliary posts 66A, 66B from splaying outward under the force of the spring 98. A detent (not shown) can be provided on the primary post 65, and/or on at least one of the auxiliary posts 66A, 66B, to resist rotation of the auxiliary posts 66A, 66B away from the primary post 65 about the first hinge 69. To move the support stand 60 to the expanded configuration (e.g., in the substantial shape of a tripod), the auxiliary posts 66A, 66B are pivoted away from the primary post 65 as a unit, about the first hinge 69. Once the auxiliary posts 66A, 66B have cleared the pocket 97, the auxiliary posts 66A, 66B can then splay away from one another about the second hinge 99, whereby the primary post 65 and auxiliary posts 66A, 66B define a substantial tripod shape.

Additional features, advantages, and embodiments of the invention are set forth or apparent from consideration of the following detailed description, drawings and claims. Moreover, it is to be understood that both the foregoing summary of the invention and the following detailed description are exemplary and intended to provide further explanation without limiting the scope of the invention as claimed.

In describing embodiments, specific terminology is employed for the sake of clarity. However, the invention is not intended to be limited to the specific terminology and examples selected. A person skilled in the relevant art will recognize that other equivalent components can be employed and other methods developed without departing from the broad concepts of the current invention.

Although the foregoing description is directed to the preferred embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

What is claimed:

1. A decorative light, comprising:

a housing defining an interior space and having an open front;

a cover mounted to the open front of the housing, the cover including a beam-splitter light lens shade and a substantially planar lens portion disposed around the beam-splitter light lens shade;

a motor located in the interior space of the housing, the motor including an output shaft;

a first light module located in the interior space and including a plurality of first light units disposed about the output shaft of the motor, wherein the output shaft is rotatable with respect to the first light units;

a second light module located in the interior space and including a plurality of second light units disposed about the output shaft of the motor, wherein the output shaft is rotatable with respect to the second light units; and a rotating lens module connected to the output shaft of the motor for rotation therewith, the rotating lens module comprising:

a centrally located refractive lens, wherein the plurality of second light units are adapted to project light through the centrally located refractive lens and the beam-splitter lens light shade, and a plurality of rotating lenses distributed about the refractive lens, wherein the plurality of first light units are adapted to project light through the rotating lenses and the substantially planar lens portion of the cover.

2. The decorative light of claim 1, wherein the plurality of first light units are disposed in a first circle and the plurality of second light units are disposed in a second circle that is concentric with the first circle.

3. The decorative light of claim 1, wherein the first light module further comprises a plurality of film slides each containing a negative image, wherein each of the plurality of film slides is located in registry with one of the first light units.

4. The decorative light of claim 3, wherein the first light module further comprises a plurality of convex lenses, wherein each of the plurality of convex lenses is located in registry with one of the first light units.

5. The decorative light of claim 4, wherein the first light module further comprises a plurality of lens sleeves, wherein each of the plurality of lens sleeves is disposed between one of the first light units and one of the plurality of convex lenses.

6. The decorative light of claim 1, wherein the refractive lens comprises a plurality of multi-angle refractive convex-lens bodies directed toward the beam-splitter lens light shade.

7. The decorative light of claim 1, wherein the plurality of first light units comprise light emitting diodes (LEDs) and/or the plurality of second light units comprise LEDs.

8. The decorative light of claim 1, wherein the beam-splitter light lens shade and the substantially planar lens portion are substantially concentric with one another.

9. The decorative light of claim 1, wherein the plurality of rotating lenses comprise a plurality of convex lenses.

10. The decorative light of claim 1, wherein the cover comprises an interior cover, the decorative light further comprising a front cover located exterior to the interior cover.

11. The decorative light of claim 1, further comprising a power supply adapted to supply power to at least one of the motor, the first light module, and/or the second light module.

12. The decorative light of claim 1, wherein the plurality of first light units are adapted to project light along a first light path through the rotating lenses and the substantially planar lens portion of the cover, and the plurality of second light units are adapted to project light along a second light path through the centrally located refractive lens and the beam-splitter lens light shade, wherein the first and second light paths do not overlap.

13. The decorative light of claim 12, wherein the first light path is substantially parallel with the second light path.

14. The decorative light of claim 13, wherein the first light path and the second light path are substantially concentric.

* * * * *